US011537058B2

(12) United States Patent
Murotani et al.

(10) Patent No.: US 11,537,058 B2
(45) Date of Patent: Dec. 27, 2022

(54) IMAGE FORMING APPARATUS

(71) Applicant: CANON KABUSHIKI KAISHA, Tokyo (JP)

(72) Inventors: Taku Murotani, Shizuoka (JP); Mitsuhiro Obara, Shizuoka (JP); Hiroki Katayama, Shizuoka (JP); Atsushi Sano, Tokyo (JP); Jun Nagatoshi, Tokyo (JP); Chihiro Shirakawa, Shizuoka (JP); Tetsushi Uneme, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/549,222

(22) Filed: Dec. 13, 2021

(65) Prior Publication Data

US 2022/0197179 A1 Jun. 23, 2022

(30) Foreign Application Priority Data

Dec. 17, 2020 (JP) ..... JP2020-209699
May 24, 2021 (JP) ..... JP2021-087163

(51) Int. Cl.
*G03G 15/04* (2006.01)
*G03G 21/18* (2006.01)
*G03G 15/01* (2006.01)

(52) U.S. Cl.
CPC ... *G03G 15/0409* (2013.01); *G03G 15/04072* (2013.01); *G03G 21/1842* (2013.01); *G03G 15/011* (2013.01); *G03G 15/0178* (2013.01); *G03G 21/1807* (2013.01); *G03G 2221/1884* (2013.01)

(58) Field of Classification Search
CPC ..... G03G 15/0409; G03G 15/04072; G03G 21/1842; G03G 15/011; G03G 15/0178; G03G 21/1807; G03G 2221/1884
See application file for complete search history.

(56) References Cited

U.S. PATENT DOCUMENTS 4,912,563 A * 3/1990 Narita ..... H04N 1/00 358/401

FOREIGN PATENT DOCUMENTS

| | | |
|---|---|---|
| JP | 2009003413 A | 1/2009 |
| JP | 2017090769 A | 5/2017 |
| JP | 2020086311 A | 6/2020 |

* cited by examiner

*Primary Examiner* — Susan S Lee
(74) *Attorney, Agent, or Firm* — Canon U.S.A., Inc. I.P. Division

(57) ABSTRACT

An image forming apparatus to form a toner image on a recording material includes a photosensitive member and an optical scanning unit. The optical scanning unit includes an optical scanning unit, an optical box, a cover member, and a moving unit movable to an outside of the image forming apparatus. The optical scanning unit and the moving unit are arranged so that the moving unit and the optical scanning unit are opposed to each other when the moving unit is located in an inside of the image forming apparatus. The optical scanning unit is disposed so as to allow a user to touch the optical scanning unit through a space generated in the inside of the image forming apparatus when the moving unit is moved to the outside of the image forming apparatus. Between the optical box and the cover member, the cover member is opposed to the moving unit.

19 Claims, 28 Drawing Sheets

IMAGE FORMING APPARATUS

BACKGROUND OF THE DISCLOSURE

Field of the Disclosure

The present disclosure relates to an image forming apparatus such as a copying machine and a printer to which an optical scanning device is mounted.

Description of the Related Art

Hitherto, an image forming apparatus that forms a color image radiates laser lights from a plurality of light sources of an optical scanning device onto corresponding photosensitive drums, respectively, to form electrostatic latent images and superimposes toner images, which are obtained by forming visible images with toners of a plurality of colors, to thereby form a color image. Each of process cartridges corresponding to the toners of a plurality of colors includes integrated process units including, for example, a photosensitive drum, a charging unit, and a developing unit, and is detachably disposed in a main body of the image forming apparatus. Further, the image forming apparatus includes a feed cassette that houses recording materials for forming toner images thereon, and has the following configuration. When a remaining amount of the recording materials becomes small, the feed cassette is drawn out from the main body of the image forming apparatus. After the feed cassette is refilled with recording materials, the feed cassette is housed into the main body of the image forming apparatus again.

For example, in Japanese Patent Application Laid-Open No. 2009-003413, the following configuration is described. A tray that supports a plurality of process cartridges arrayed in a so-called in-line method is provided inside an image forming apparatus, and the tray is drawn out to an outside of the image forming apparatus at the time of replacing the process cartridges. Further, for example, in Japanese Patent Application Laid-Open No. 2017-90769, an image forming apparatus having the following configuration is described. A feed cassette configured to house recording materials is provided inside the image forming apparatus. The feed cassette is drawn out to an outside of the image forming apparatus, and is refilled with recording materials.

However, in the image forming apparatus described in Japanese Patent Application Laid-Open No. 2009-003413, when the tray having the process cartridges thereon is drawn out to the outside of the image forming apparatus, an empty space is defined in the arrangement place of the process cartridges. Then, a person can insert a hand into the empty space, and the person's hand is enabled to directly touch an optical box of an optical scanning device disposed adjacent to the empty space. Moreover, in the image forming apparatus described in Japanese Patent Application Laid-Open No. 2017-90769, a person can insert a hand into an empty space defined when the feed cassette is drawn out to the outside of the image forming apparatus. A partition is provided between the feed cassette and the optical scanning device, and hence the person's hand cannot directly touch the optical box of the optical scanning device. However, when the partition is eliminated, for example, for downsizing of the image forming apparatus, then the person's hand is enabled to directly touch the optical box.

In the configuration of Japanese Patent Application Laid-Open No. 2009-003413, and in the configuration of Japanese Patent Application Laid-Open No. 2017-90769 in which the partition is eliminated, when the person's hand comes into contact with the optical box, and the optical box is pressed, the optical box may be deformed by the stress applied to the optical box. When the stress is applied to the optical box, postures of optical components such as lenses and reflecting mirrors, which are arranged in the optical box may be changed. As a result, a position of irradiating the photosensitive drum with the laser light emitted from the optical scanning device may be changed, and desired image quality cannot be obtained for an image to be formed. Further, the optical box or the like may sometimes be charged by contact of the person's hand with the optical scanning device. As a result, an electrostatic discharge (ESD) may occur in ICs of a laser driver, a motor driver, a beam detection (BD) sensor, and the like provided inside the optical scanning device, with the result that the ICs may sometimes be broken.

SUMMARY OF THE DISCLOSURE

Disclosed herein is an image forming apparatus that works towards preventing image quality from being degraded due to an optical box being pressed.

According to an aspect of the present disclosure, an image forming apparatus to form a toner image on a recording material includes a photosensitive member, and an optical scanning unit configured to scan the photosensitive member with a laser light according to image information, wherein the optical scanning unit includes: a light source, a deflector configured to deflect the laser light emitted from the light source, an imaging lens configured to form an image of the laser light deflected by the deflector, an optical box configured to hold the deflector and the imaging lens, a cover member configured to cover an opening of the optical box, and a moving unit movable to an outside of the image forming apparatus, wherein the optical scanning unit and the moving unit are arranged so that the moving unit and the optical scanning unit are opposed to each other in a state in which the moving unit is located in an inside of the image forming apparatus, wherein the optical scanning unit is disposed so as to allow a user to touch the optical scanning unit through a space generated in the inside of the image forming apparatus when the moving unit is moved to the outside of the image forming apparatus, and wherein, of the optical box and the cover member, the cover member is opposed to the moving unit.

Further features of the present disclosure will become apparent from the following description of exemplary embodiments with reference to the attached drawings.

DESCRIPTION OF THE EMBODIMENTS

Embodiments of the present disclosure are described below in detail with reference to the drawings.

First Embodiment

[Image Forming Apparatus]

Figure 1:
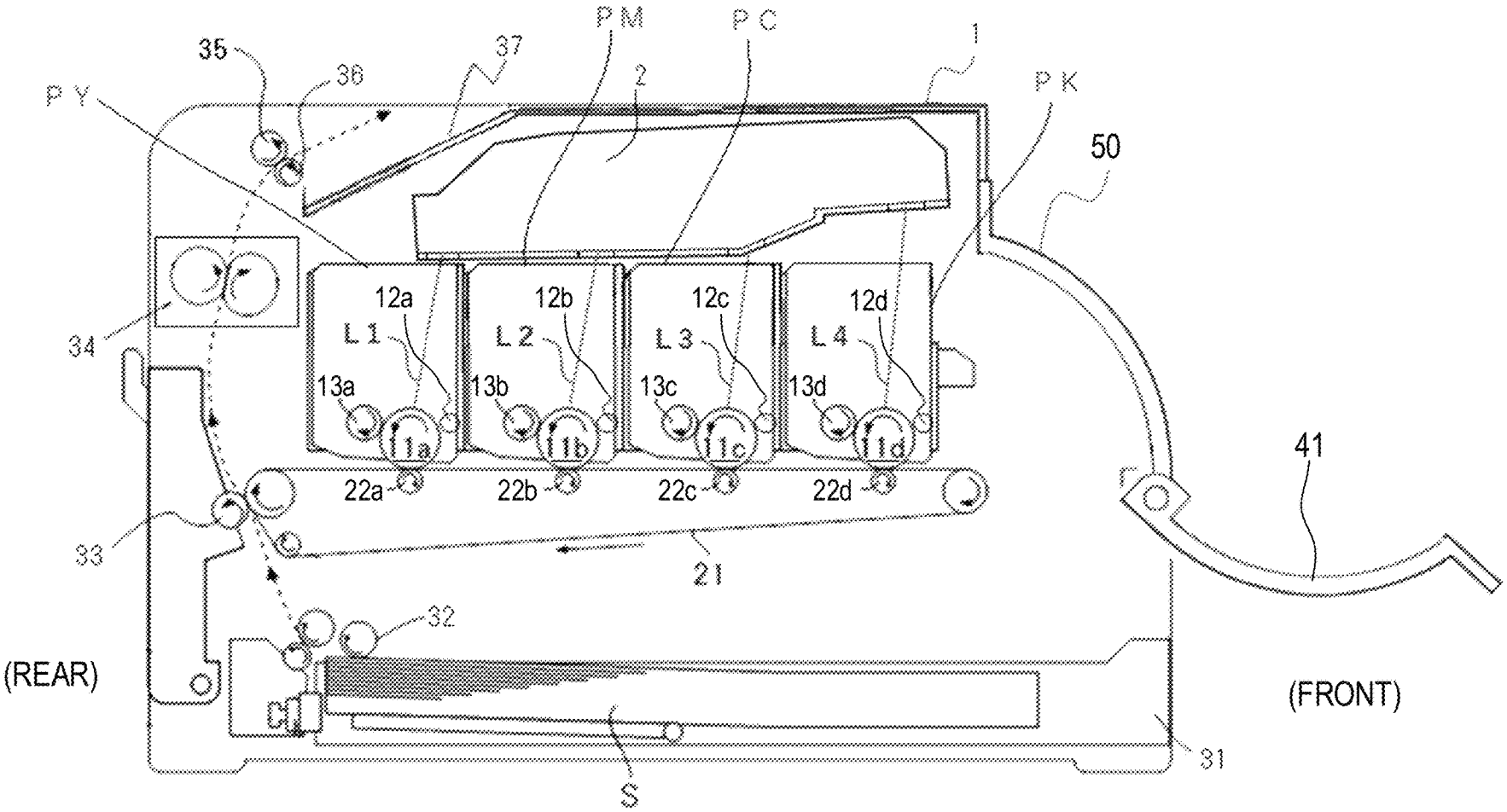
FIG. 1 is a schematic sectional view for illustrating a configuration of an image forming apparatus of a first embodiment.

FIG. 1 is a schematic sectional view for illustrating a configuration of an image forming apparatus 1 of a first embodiment. The image forming apparatus 1 has a configuration in which an optical scanning device 2 and process cartridges PY, PM, PC and PK are mounted on a main body. The image forming apparatus 1 of this embodiment superimposes toner images, which are obtained by forming visible images with toners of four colors including yellow (Y), magenta (M), cyan (C), and black (K) on one another, to thereby form a full color image. As illustrated in FIG. 1, the process cartridges PY, PM, PC, and PK have the same configuration. The letters "a", "b", "c", and "d" on ends of reference symbols of members of the respective process cartridges indicate that the members denoted thereby are members of the process cartridges PY, PM, PC, and PK, respectively. In the following description, the description of "a", "b", "c", and "d" on the ends of the reference symbols is omitted unless the members of a specific process cartridge are mentioned.

Further, in the first embodiment, a side of the image forming apparatus 1 on which a door 41 to be described later is provided is defined as a "front" side of the image forming apparatus 1, and a side opposite to the door 41 is defined as a "rear" side of the image forming apparatus 1. Moreover, a right side of the image forming apparatus 1 when the "rear" side is viewed from the "front" side is defined as "right", and a left side of the image forming apparatus 1 when the "rear" side is viewed from the "front" side is defined as "left."

With reference to FIG. 1, a description is given of the configuration and image forming process of the image forming apparatus 1. The optical scanning device 2 is disposed vertically above the process cartridges PY, PM, PC, and PK, and radiates laser lights L1, L2, L3, and L4, which correspond to image data, to photosensitive drums 11 which are image bearing members bearing the toner images of the process cartridges PY, PM, PC, and PK. The photosensitive drum 11 of each process cartridge is charged in advance to a uniform potential by a charging roller 12, and charges are released only from portions irradiated with the laser light emitted from the optical scanning device 2. In this way, an electrostatic latent image is formed on the surface of the photosensitive drum 11. Toner is caused to adhere to the electrostatic latent image on each photosensitive drum 11 by each developing roller 13, and the toner image is formed. A primary transfer roller 22 is disposed at a position facing each photosensitive drum 11, and a transfer voltage is applied to the primary transfer roller 22. Accordingly, the toner image on each photosensitive drum 11 is sequentially transferred in superimposition onto an intermediate transfer belt 21.

Meanwhile, recording materials S which are recording media placed into a feed cassette 31 disposed vertically below the intermediate transfer belt 21 are fed from the feed cassette 31 by a pickup roller 32 in synchronization with the above-mentioned image forming process of each process cartridge. Each of the recording materials S fed from the feed cassette 31 that is a loading unit is conveyed to a secondary transfer roller 33. Then, the four-color toner images transferred onto the intermediate transfer belt 21 are transferred to the recording material S by the secondary transfer roller 33. The recording material S onto which the toner images are transferred is conveyed to a fixing device 34, and is heated and pressed in the fixing device 34. Accordingly, the toner images are fixed to the recording materials S. After that, the recording material S that has passed through the fixing device 34 is delivered to an external delivery tray 37 by delivery rollers 35 and 36.

[Optical Scanning Device]

Figure 2:
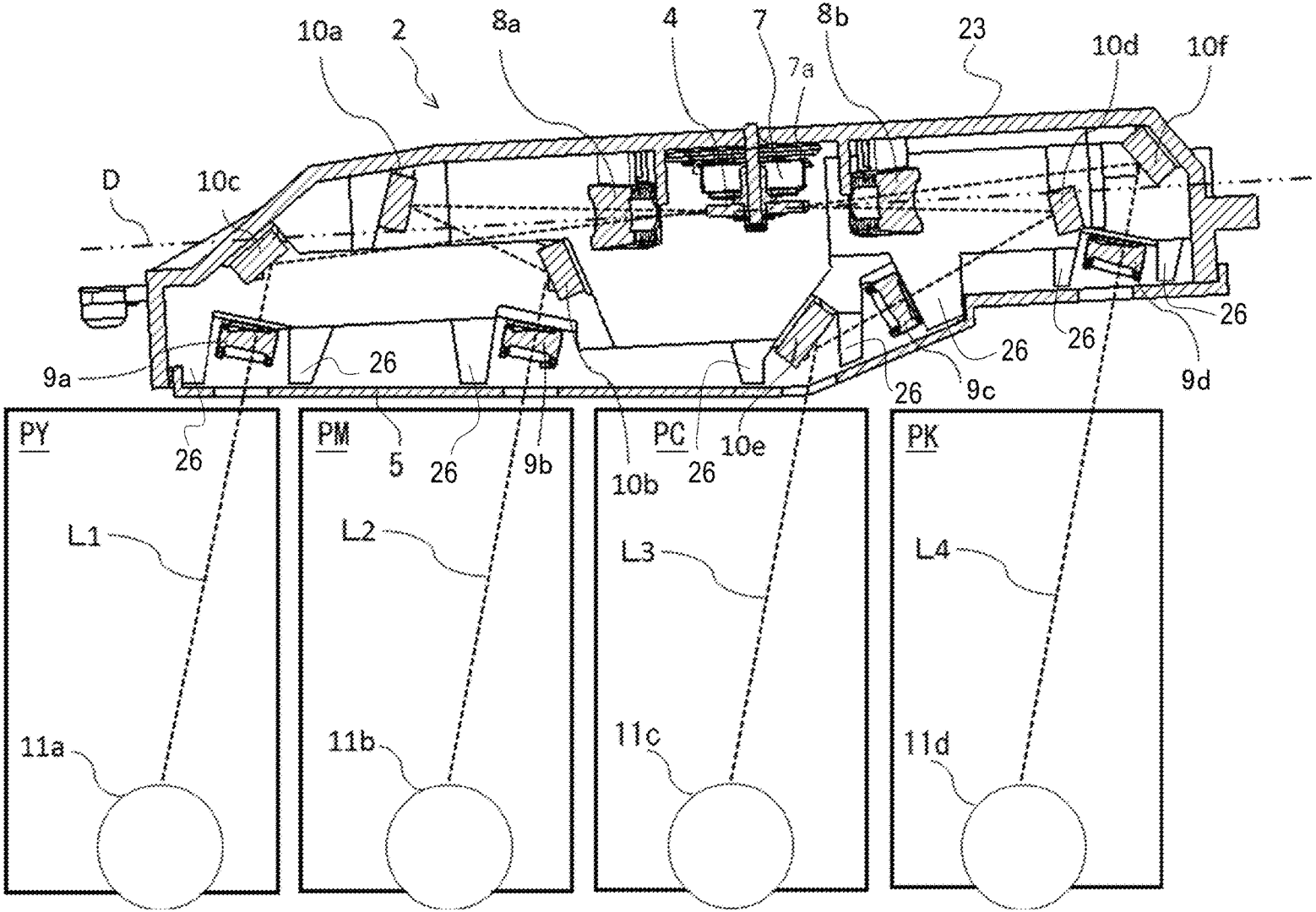
FIG. 2 is a schematic sectional view for illustrating a configuration of an optical scanning device of the first embodiment.

FIG. 2 is a schematic sectional view for illustrating a configuration of the optical scanning device 2 that exposes the photosensitive drums 11, which are photosensitive members illustrated in FIG. 1, to light. The optical scanning device 2 deflects the laser lights (light beams) L1, L2, L3, and L4 emitted from semiconductor lasers (not shown), which are a plurality of light sources, by a rotary polygon mirror 4 provided in a deflector 7, and radiates the laser lights to the corresponding photosensitive drums 11*a*, 11*b*, 11*c*, and 11*d* through optical members. The optical scanning device 2 includes: the deflector 7 having the rotary polygon mirror 4; first imaging lenses 8*a* and 8*b* and second imaging lenses 9*a*, 9*b*, 9*c*, and 9*d*, which are imaging members of the laser light; reflecting mirrors 10*a*, 10*b*, 10*c*, 10*d*, 10*e*, and 10*f* which are reflection members; and an optical box 23 in which these members are arranged. In order to tightly close the optical box 23, the optical scanning device 2 further includes a cover member 5 that closes (covers) an opening portion of the optical box 23.

Further, in FIG. 2, backup portions 26 which are rib portions are provided near optical components (optical systems) inside the optical box 23. The backup portions 26 are provided upright toward the cover member 5 from structural members, support members, a bottom surface, or the like inside the optical box 23, and have a length of about 1 mm as a clearance (distance) between the cover member 5 and distal end portions of the backup portions 26, which are close to the cover member 5. Accordingly, the optical components (for example, the second imaging lenses 9) inside the optical scanning device 2, which are arranged with a clearance larger than the clearance between the cover member 5 and the distal end portions of the backup portions 26, can be prevented from directly coming into contact the cover member 5.

The optical box 23 is disposed vertically above the process cartridges PY, PM, PC, and PK, and the cover member 5 is disposed vertically below the optical box 23. That is, the cover member 5 is disposed so as to face the process cartridges PY, PM, PC, and PK. Further, in the deflector 7, a drive circuit board 7*a* for rotationally driving the rotary polygon mirror 4 is fixed to the bottom surface of the optical box 23, and the rotary polygon mirror 4 is disposed vertically below the drive circuit board 7*a*.

Next, operations of the optical scanning device 2 are described. The laser lights L1, L2, L3, and L4 emitted from the plurality of semiconductor lasers (not shown) pass through a plurality of lenses (not shown), enter the rotary polygon mirror 4 while being inclined with respect to a scanning plane D, and are deflected (deflection-scanned) by the rotary polygon mirror 4. The laser light L1 deflected by the rotary polygon mirror 4 passes through the first imaging lens 8*a*. After that, a light path of the laser light L1 is deflected by the reflecting mirror 10*c* corresponding to the process cartridge PY. Then, the laser light L1 passes through the second imaging lens 9*a* and an opening portion of the cover member 5, and scans the surface of the photosensitive drum 11*a* at a constant speed while forming spots on the photosensitive drum 11*a* of the corresponding process cartridge PY.

The laser light L2 deflected by the rotary polygon mirror 4 passes through the first imaging lens 8*a*. After that, a light path of the laser light L2 is deflected by the reflecting mirrors 10*a* and 10*b* corresponding to the process cartridge PM. Then, the laser light L2 passes through the second imaging lens 9*b* and an opening portion of the cover member 5, and scans the surface of the photosensitive drum 11*b* at a constant speed while forming spots on the photosensitive drum 11*b* of the corresponding process cartridge PM.

The laser light L3 deflected by the rotary polygon mirror 4 passes through the first imaging lens 8*b*. After that, a light path of the laser light L3 is deflected by the reflecting mirror 10*d* corresponding to the process cartridge PC. Then, the laser light L3 passes through the second imaging lens 9*c*, the reflecting mirror 10*e*, and an opening portion of the cover member 5, and scans the surface of the photosensitive drum 11*c* at a constant speed while forming spots on the photosensitive drum 11*c* of the corresponding process cartridge PC.

The laser light L4 deflected by the rotary polygon mirror 4 passes through the first imaging lens 8*b*. After that, a light path of the laser light L4 is deflected by the reflecting mirror 10*f* corresponding to the process cartridge PK. Then, the laser light L4 passes through the second imaging lens 9*d* and an opening portion of the cover member 5, and scans the surface of the photosensitive drum 11*d* at a constant speed while forming spots on the photosensitive drum 11*d* of the corresponding process cartridge PK.

[Replacement of Process Cartridge]

FIG. 3, FIG. 4, FIG. 5, and FIG. 6 are explanatory views for illustrating a method of replacing the process cartridges in the image forming apparatus 1. In each of the process cartridges PY, PM, PC, and PK, toner (developer) housed in a developing device 14 is consumed as the toner is used for image formation. Then, when the toner is consumed, and it becomes impossible to form an image, the process cartridge that has run out of the toner is replaced with a new process cartridge. The process cartridges PY, PM, PC, and PK in this embodiment are placed on a cartridge tray 40 (moving unit) of a draw-out type. Accordingly, the replacement of the process cartridge is performed by a method of drawing out the cartridge tray 40 from the image forming apparatus 1, replacing the process cartridge to be replaced, and then housing the cartridge tray 40 to the image forming apparatus 1 again.

[Door of Image Forming Apparatus]

Figure 3:
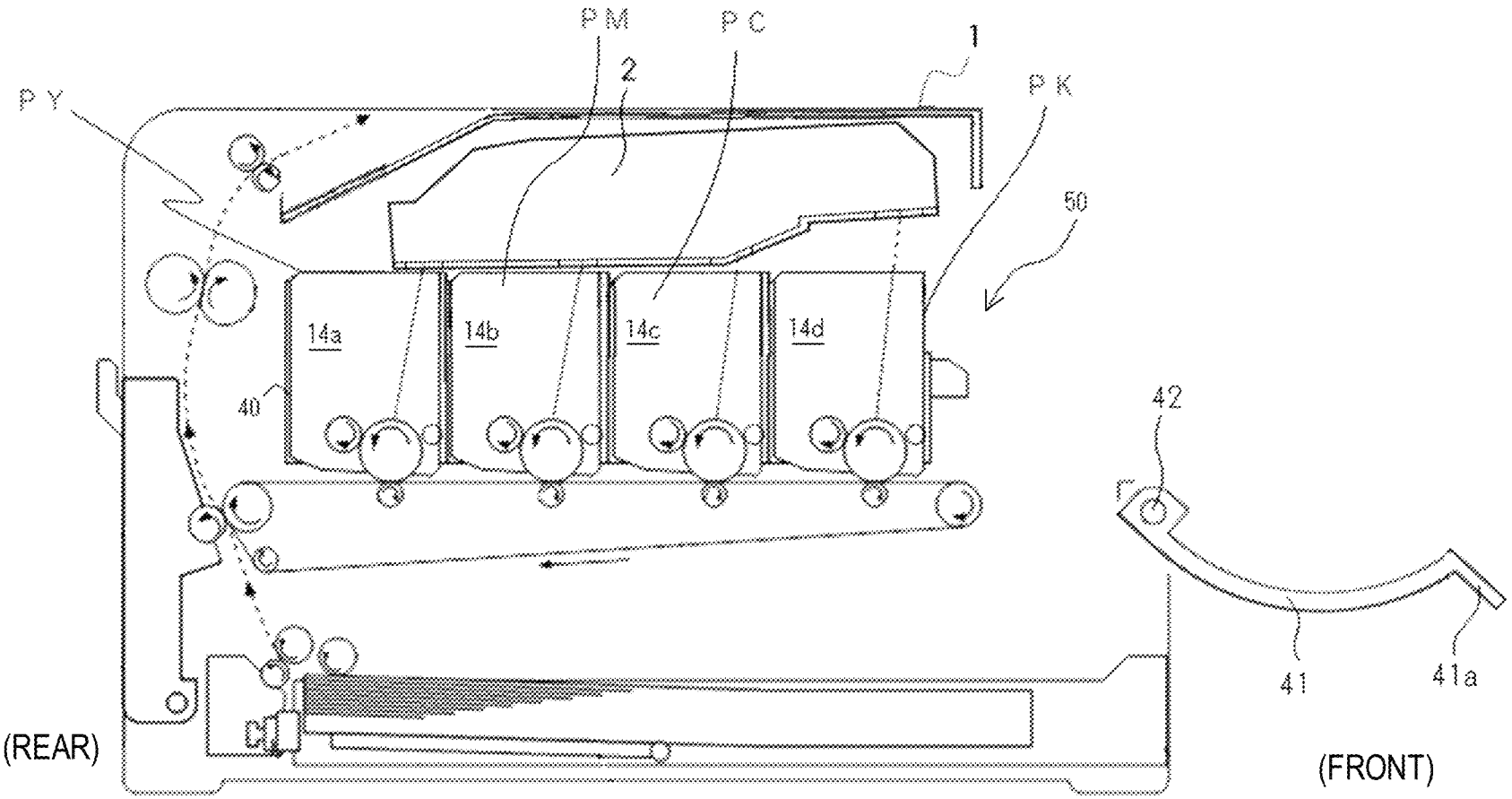
FIG. 3 is an explanatory view for illustrating replacement of process cartridges of the first embodiment.

FIG. 3 is an explanatory schematic sectional view of the image forming apparatus, for illustrating the door 41 for maintenance in the image forming apparatus 1. FIG. 3 shows an opened state of the door 41. In the door 41, a gripper 41*a* (finger engageable portion) for opening and closing the door 41 is provided at one end portion, and another end portion is pivotable about a horizontal shaft 42. As illustrated in FIG. 3, the door 41 is operated to open or close when the cartridge tray 40 is drawn out or the cartridge tray 40 is housed into the image forming apparatus 1. FIG. 1 shows both of a closed state of the door 41 and an opened state thereof. When the door 41 is opened, an opening portion 50 through which the cartridge tray 40 passes appears.

Figure 4:
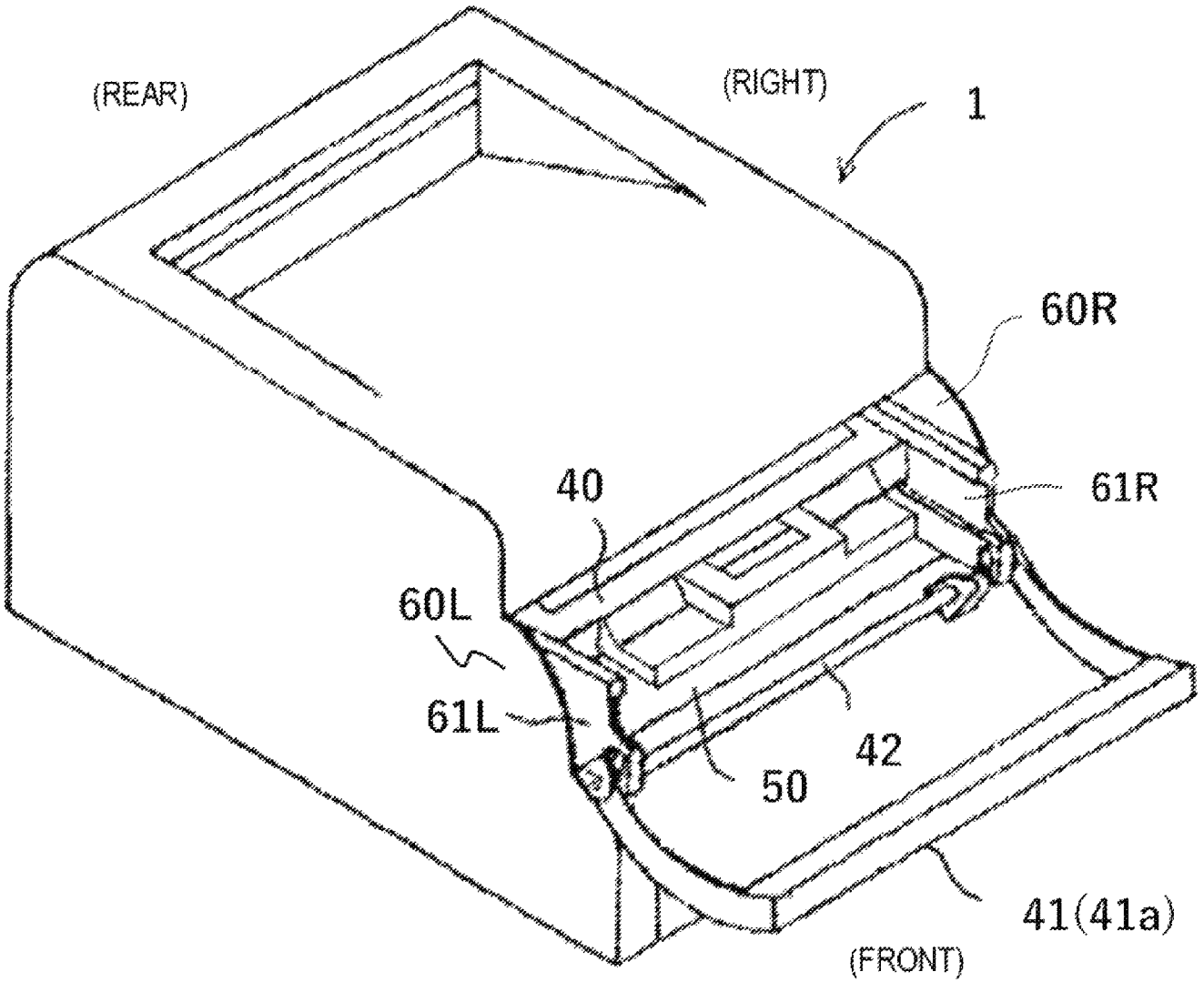
FIG. 4 is an explanatory view for illustrating the replacement of the process cartridges of the first embodiment.
Figure 5:
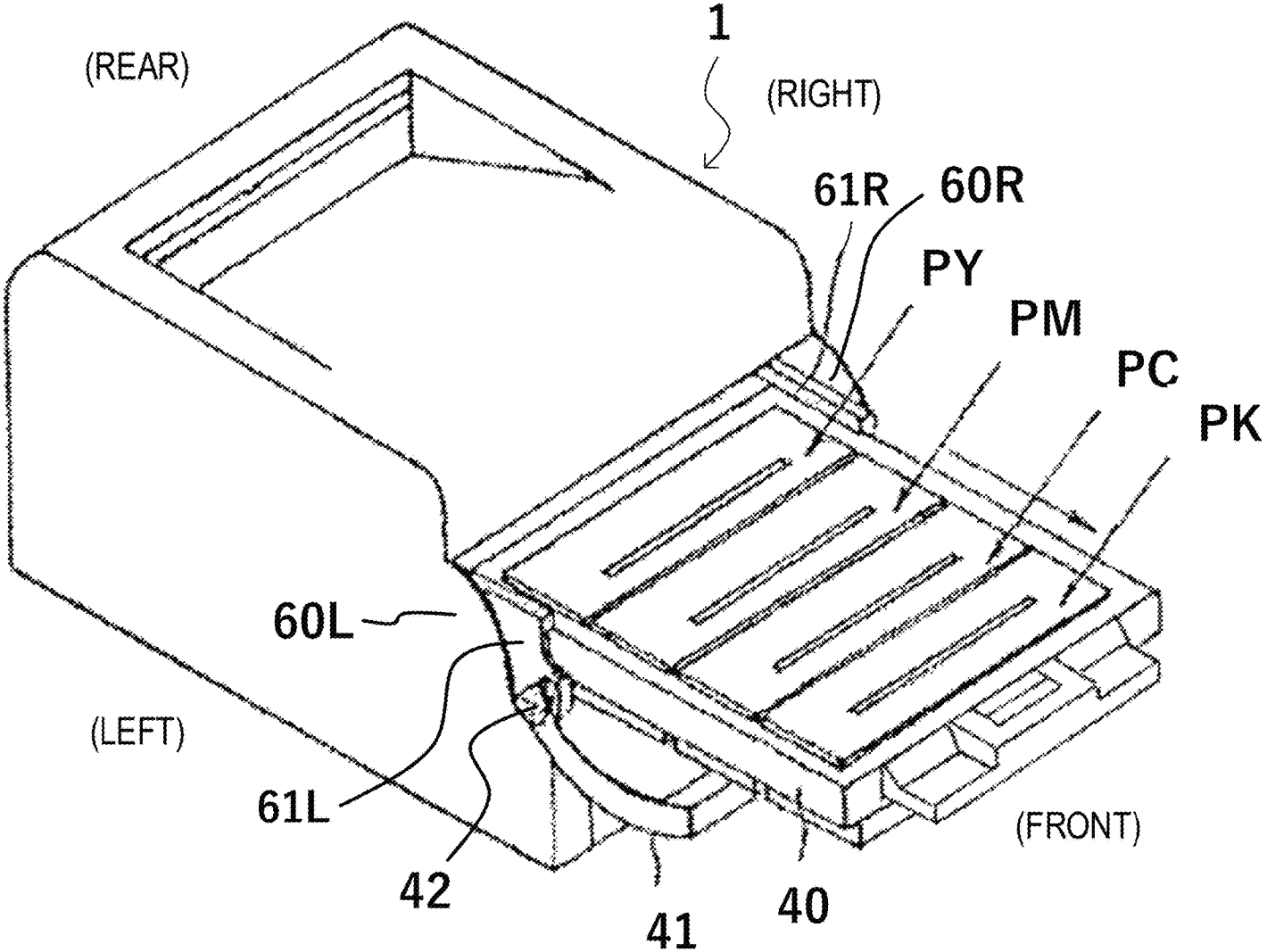
FIG. 5 is an explanatory view for illustrating the replacement of the process cartridges of the first embodiment.

FIG. 4 is a perspective view for illustrating a state in which the door 41 is opened and the cartridge tray 40 is housed in the image forming apparatus 1. Meanwhile, FIG. 5 is a perspective view for illustrating a state in which the door 41 is opened and the cartridge tray 40 is drawn out from the image forming apparatus 1. As illustrated in FIG. 4, the door 41 has the horizontal shaft 42 as a hinge inserted therethrough on the right and left sides in FIG. 4, and is made pivotable about the horizontal shaft 42 with respect to the image forming apparatus 1. That is, the door 41 is pivotably moved about the horizontal shaft 42 so as to rise upward in FIG. 4, and can thereby close the opening portion 50 of the image forming apparatus 1. Meanwhile, the door 41 is pivotably moved about the horizontal shaft 42 so as to be fall down forward (toward the lower right side in FIG. 4) of the image forming apparatus 1, and can thereby open the opening portion 50. On an inner side of a left frame 60L and a right frame 60R forming a frame body of the image forming apparatus 1, there are arranged a left and right pair of tray holding members 61L and 61R which hold the cartridge tray 40. The tray holding members 61L and 61R are provided to face each other, and the cartridge tray 40 that is a frame-shaped member is sandwiched between the tray holding member 61L and the tray holding member 61R. Then, as illustrated in FIG. 5, the cartridge tray 40 is sandwiched between the tray holding members 61L and 61R, and hence the cartridge tray 40 is movable forward and backward along the tray holding members 61L and 61R. As described above, the process cartridges PY, PM, PC, and PK are placed and supported on the cartridge tray 40, and each of the process cartridges is mounted so as to be individually detachable as required.

Figure 6:
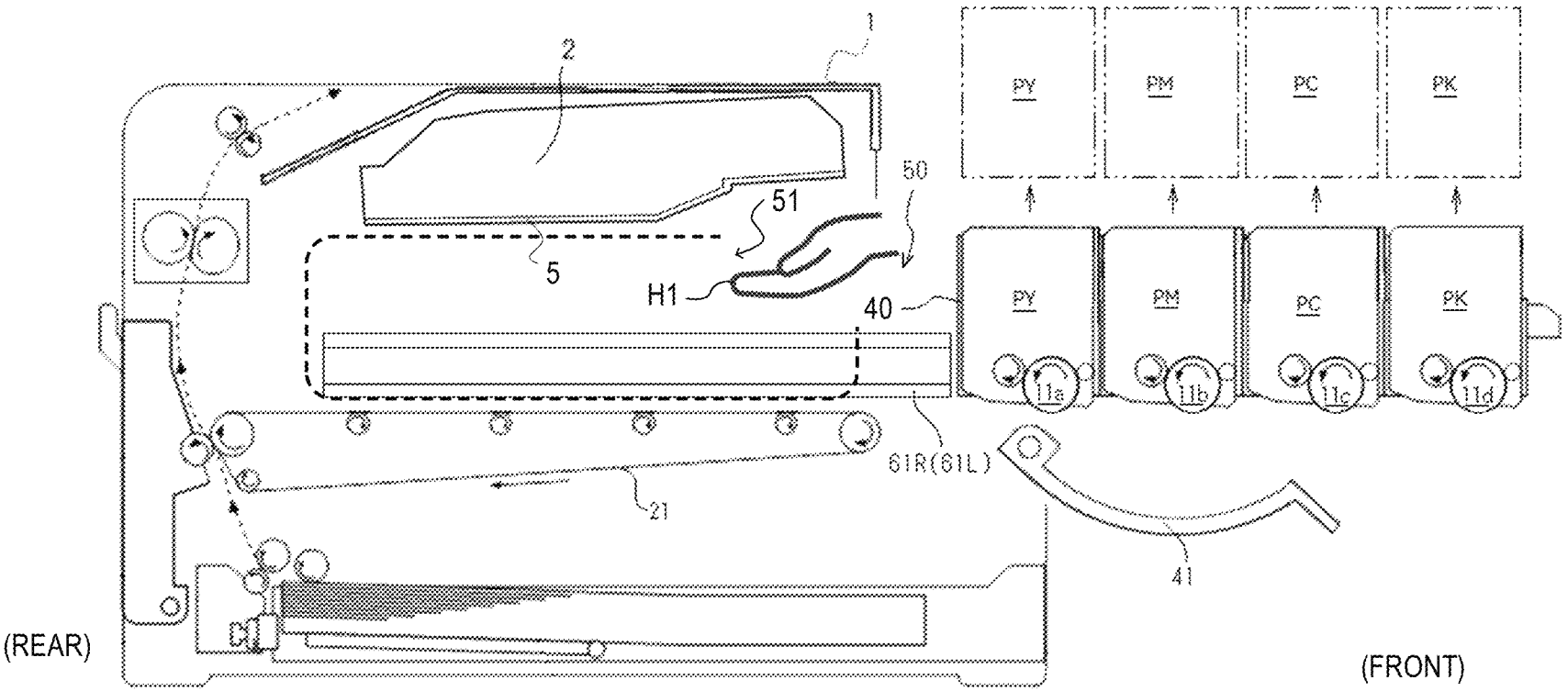
FIG. 6 is an explanatory view for illustrating the replacement of the process cartridges of the first embodiment.

FIG. 6 is a schematic sectional view for illustrating a state in which the cartridge tray 40 having the process cartridges PY, PM, PC, and PK placed thereon is drawn out to the outside of the image forming apparatus 1 in order to replace the process cartridges. As illustrated in FIG. 6, when the door 41 is opened, the cartridge tray 40 is movable forward of the image forming apparatus 1 from housing positions on the tray holding members 61L and 61R through the opening portion 50. In FIG. 6, the cartridge tray 40 is in a state in which the process cartridges PY, PM, PC, and PK placed on the cartridge tray 40 are drawn out to the outside of the image forming apparatus 1 (that is, to a drawn-out position). Note that, when the cartridge tray 40 is drawn out to the outside from the image forming apparatus 1 by a predetermined amount from the tray holding members 61L and 61R, a further movement thereof to be drawn out is restricted by a stopper portion (not shown), and such a drawn-out position where the cartridge tray 40 is drawn out is maintained.

Then, when the cartridge tray 40 is drawn out from the image forming apparatus 1, the process cartridge is replaced next. First, the used process cartridge to be replaced is lifted upward in FIG. 6, and is detached from the cartridge tray 40. Next, a new process cartridge is placed on a position of the detached process cartridge on the cartridge tray 40, and is mounted on the cartridge tray 40. When such replacement of the process cartridge is ended, the cartridge tray 40 is moved to the housing position in order to house the cartridge tray 40 into the image forming apparatus 1 from the drawn-out position where the cartridge tray 40 is drawn out to the outside of the image forming apparatus 1. When such movement to the housing position is ended, the door 41 is closed. Then, in conjunction with an operation to close the door 41, the cartridge tray 40 moves from the housing position to a transfer contact position where the photosensitive drums 11 in the respective process cartridges face the primary transfer rollers 22. Then, in conjunction with the movement of the cartridge tray 40, the respective process cartridges PY, PM, PC, and PK are pressed by pressing members (not shown), and are fixed at predetermined positions. As a result, as illustrated in FIG. 1, the photosensitive drums 11 of the respective process cartridges PY, PM, PC, and PK are fixed at positions facing the corresponding primary transfer rollers 22, and the toner images on the photosensitive drums 11 come into contact with the intermediate transfer belt 21. As a result, image formation is enabled.

Incidentally, when the cartridge tray 40 is drawn out to the outside of the image forming apparatus 1 at the time when the process cartridge is replaced, then inside the image forming apparatus 1, an empty space 51 is defined at a housing position of the cartridge tray 40 before being drawn. For the purpose of downsizing, no partition is provided between the optical scanning device 2 and the process cartridges PY, PM, PC, and PK. Accordingly, the cover member 5 of the optical scanning device 2 is exposed to the empty space 51. Thus, a person can insert a hand H1 from the opening portion 50 into the empty space 51, and there is a fear in that the hand H1 incorrectly touches the cover member 5 of the optical scanning device 2 to press the cover member 5.

[Mounting of Cover Member of Optical Scanning Device]

Figure 7:
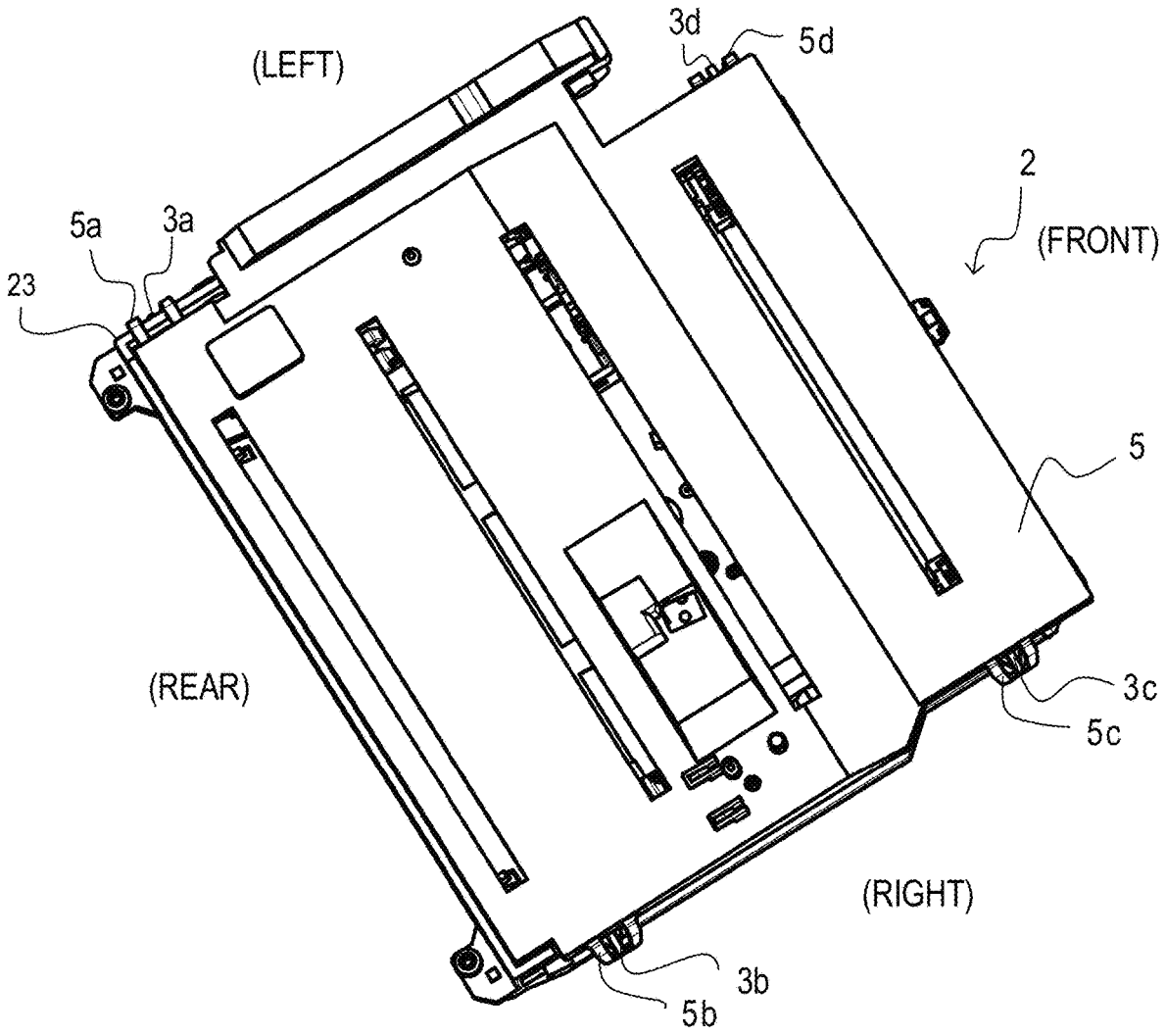
FIG. 7 is an explanatory view for illustrating a method of fixing a cover member of the optical scanning device of the first embodiment.

FIG. 7 is an explanatory schematic view for illustrating a method of fixing the cover member 5 to the optical scanning device 2. As illustrated in FIG. 1 and FIG. 2, in the optical scanning device 2, the optical box 23 is disposed on a vertically upper side, and the cover member 5 is disposed on a vertically lower side. FIG. 7 is a perspective view for illustrating an outer shape of the optical scanning device 2 when the optical scanning device 2 is viewed from the cover member 5. Four elongated opening portions provided in the cover member 5 are the opening portions through which the laser lights L1 to L4 illustrated in FIG. 2 pass.

In order to fix the cover member 5 to the optical box 23, the cover member 5 includes fixing portions 5*a*, 5*b*, 5*c*, and 5*d* of snap-fit structures molded integrally with the cover member 5. Each of the fixing portions 5*a*, 5*b*, 5*c*, and 5*d* of the snap-fit structures has a square shape in which a center portion is opened. Meanwhile, protruding portions 3*a*, 3*b*, 3*c*, and 3*d* for fixing the cover member 5 are provided near four corners of the optical box 23 of the optical scanning device 2.

When the cover member 5 is assembled to the optical box 23, the respective fixing portions of the snap-fit structures elastically bend, and thereby get over the respective protruding portions 3 provided in the optical box 23 and corresponding to the respective fixing portions of the snap-fit structures. In this way, the protruding portions 3 engage with the opening portions of the respective fixing portions of the snap-fit structures. As a result, the protruding portions 3*a*, 3*b*, 3*c*, and 3*d* protrude from the opening portions of the fixing portions 5*a*, 5*b*, 5*c*, and 5*d* of the snap-fit structures. Accordingly, the cover member 5 is fixed to the optical box 23.

[Deformation of Cover Member of Optical Scanning Device]

Figure 8:
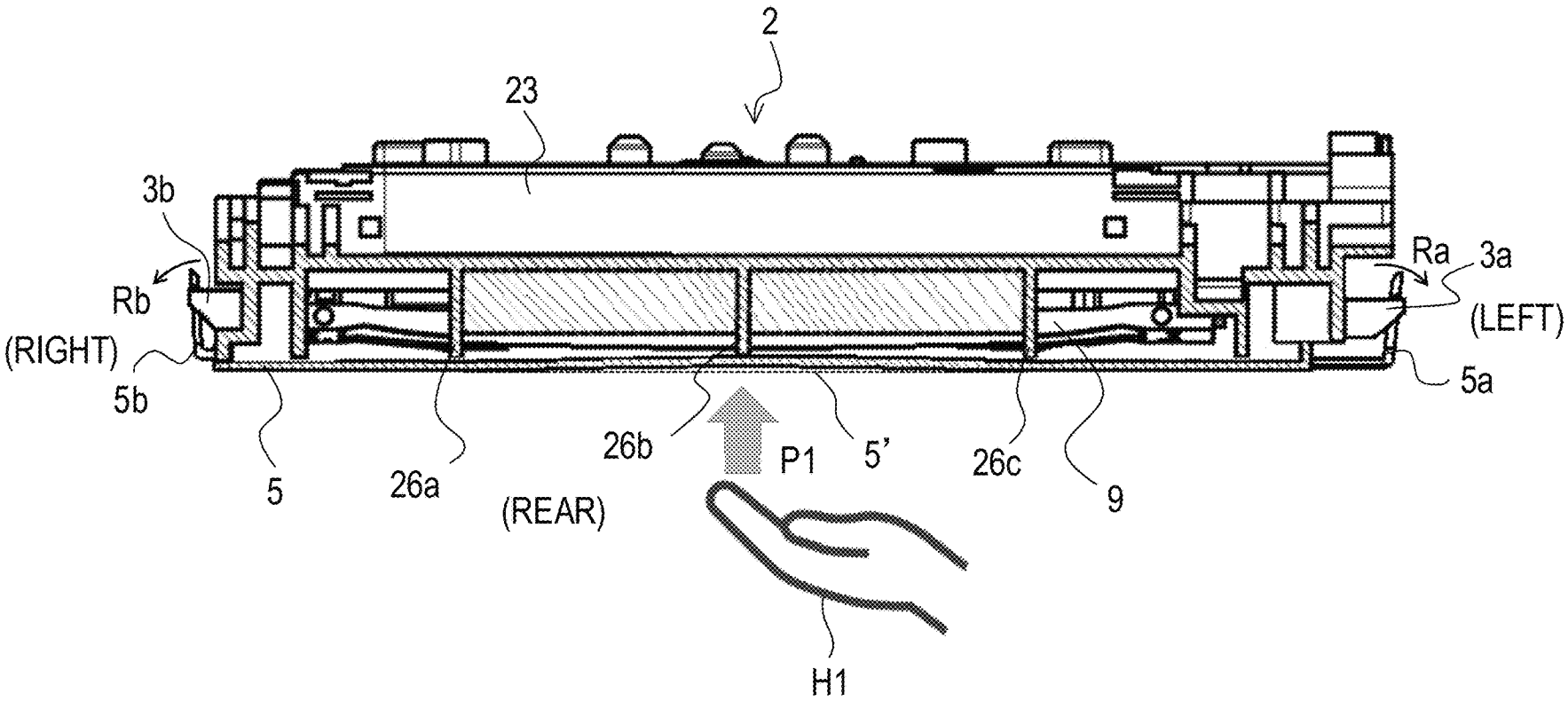
FIG. 8 is an explanatory view for illustrating deformation of the cover member of the optical scanning device of the first embodiment.

FIG. 8 is an explanatory sectional view of the optical scanning device 2, for illustrating a state of deformation of the cover member 5 when the person's hand H1 touches the cover member 5 of the optical scanning device 2. FIG. 8 is a sectional view of a cross section, which is taken along vicinities of positions where the protruding portions 3*a* and 3*b* engage with the fixing portions 5*a* and 5*b* of the snap-fit structures, respectively in a state in which the cover member 5 illustrated in FIG. 7 is fixed to the optical scanning device 2, as viewed forward from the rear side of the optical scanning device 2 of FIG. 7. In FIG. 8, from the cross section, the second imaging lens 9*a* through which the laser light L1 passes is seen. Moreover, three rib portions provided upright from a center portion of the optical box 23 of FIG. 8 toward the cover member 5 are the backup portions 26 (26*a*, 26*b*, and 26*c*) to be described later.

As illustrated in FIG. 8, when the hand H1 is inserted from the opening portion and touches the cover member 5 of the optical scanning device 2 at the time of replacement of the process cartridge, a pressing force P1 of from 5 N to 20 N is applied to the cover member 5 toward the optical box with reference to a pressing force of ordinary persons. When the cover member 5 is bent by the pressing force P1, the fixing portions 5*a* and 5*b* of the snap-fit structures which are provided on the cover member 5 (the fixing portions 5*c* and 5*d* are not shown in FIG. 8) are elastically deformed in directions of arrows Ra and Rb in FIG. 8. In addition, the cover member 5 is deformed inward of the optical box 23 from an original position 5' (illustrated by a dotted line in FIG. 8), and comes into contact with the backup portions 26 for restricting the deformation, which is provided in the optical box 23. The backup portions 26 are provided near the optical components (for example, the second imaging lens 9*a*) arranged in the optical box 23. The backup portions 26 have a length of about 1 mm as a clearance (distance) between the cover member 5 and the distal end portions of the backup portions 26 themselves, which are close to the cover member 5. Accordingly, the optical components inside the optical scanning device 2, which are arranged with a clearance larger than the clearance between the cover member 5 and the backup portions 26, can be prevented from directly coming into contact with the cover member 5.

As mentioned above, even when the person's hand H1 touches the optical scanning device 2 at the time of moving the cartridge tray 40 to the outside of the image forming apparatus 1 during the replacement of the process cartridge, optical characteristics of the optical components do not change or quality of an image therefrom does not degrade due to fluctuations in the postures of the optical components.

In this embodiment, the description has been given of the configuration in which the backup portions 26 for reducing the bending that occurs when the person's hand H1 comes into contact with the cover member 5 is provided close to the optical box 23. However, such backup portions 26 as follows may be provided on the cover member 5. That is, on a surface of the cover member 5, which faces the bottom surface of the optical box 23 in which the optical members are arranged or faces inner structures and the like thereof, the backup portions 26 are provided. The backup portions 26 are provided upright vertically toward the optical box 23, and have distal end portions having a length of about 1 mm as a clearance with the surface facing the optical box 23. Thus, even when the cover member 5 is pressed toward the optical box 23, the backup portions 26 provided on the cover member 5 come into contact with the facing surface of the optical box 23 before the cover member 5 comes into contact with the optical members. Thus, the optical components inside the optical scanning device 2, which are arranged with a clearance larger than the clearance of the backup portions 26, can be prevented from directly coming into contact with the cover member 5.

As described above, according to this embodiment, the image quality can be prevented from being degraded by the fact that the optical box is pressed.

Second Embodiment

In the first embodiment, the description has been given of the embodiment of the image forming apparatus with the configuration in which the optical scanning device is disposed vertically above the process cartridges. In a second embodiment, a description is given of an embodiment of an image forming apparatus with a configuration in which an optical scanning device is installed vertically below process cartridges and a feed cassette (moving unit) that feeds recording materials is disposed vertically below the optical scanning device.

[Image Forming Apparatus]

Figure 9:
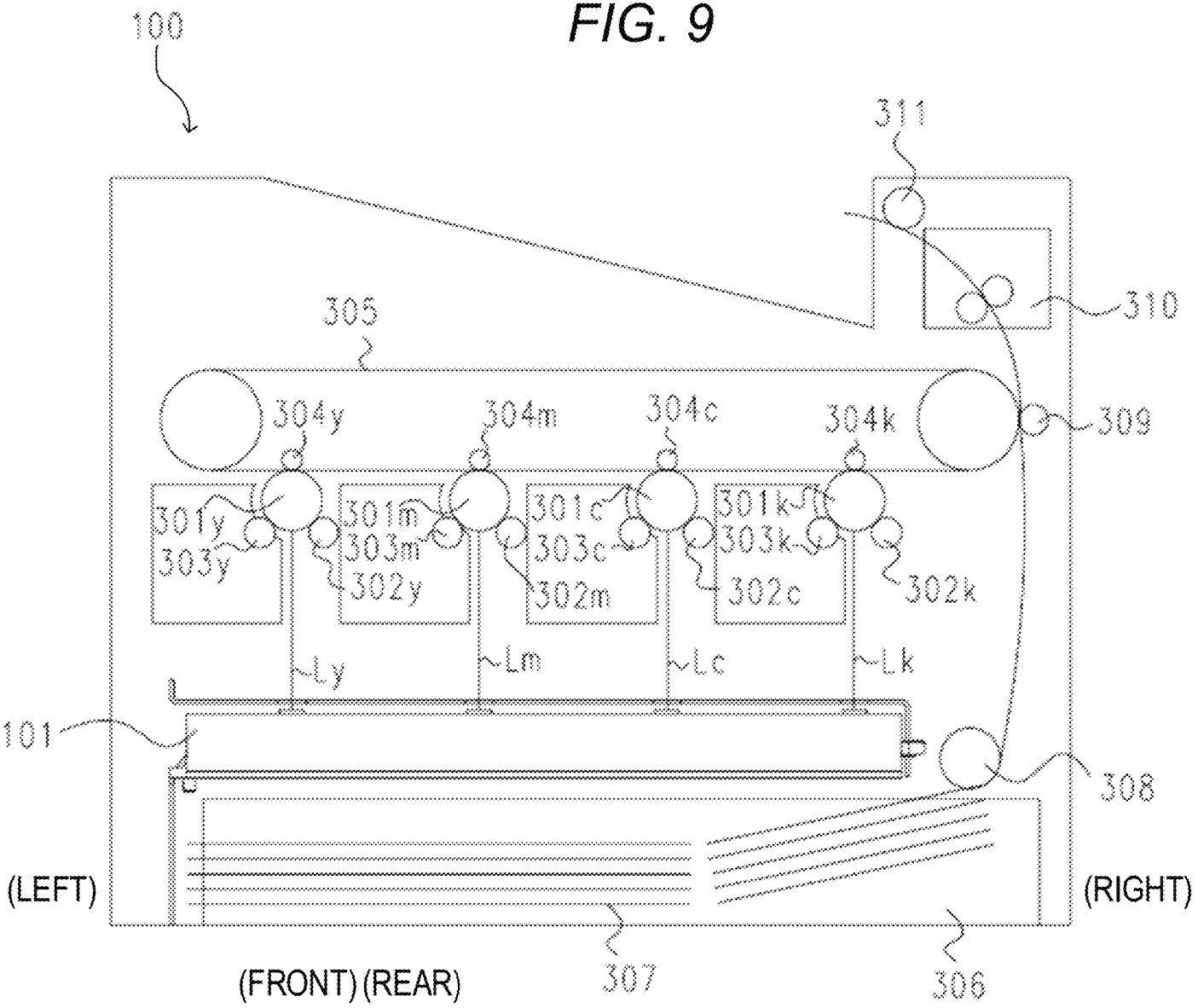
FIG. 9 is a schematic sectional view for illustrating a configuration of an image forming apparatus of a second embodiment.

FIG. 9 is a schematic sectional view for illustrating a configuration of an image forming apparatus 100 of the second embodiment. The image forming apparatus 100 has a configuration in which an optical scanning device 101 and image forming units of yellow (y), magenta (m), cyan (c), and black (K) are mounted on a main body. The image forming apparatus 100 of this embodiment superimposes toner images, which are obtained by forming visible images with toners of four colors including yellow (y), magenta (m), cyan (c), and black (k) on one another, to thereby form a full color image. As illustrated in FIG. 9, the respective image forming units have the same configuration though colors of the toners thereof are different from one another. Further, the letters "y", "m", "c", and "k" on ends of reference symbols of members of the respective image forming units indicate that the members in the image forming units are those in which the toner colors are yellow (y), magenta (m), cyan (c), and black (k), respectively. In the following description, the description of "y", "m", "c", and "k" on the ends of the reference symbols is omitted unless the members of a specific image forming unit are mentioned.

Further, in the second embodiment, a side of the image forming apparatus 100 in a direction of drawing out a feed cassette 306 to be described later is defined as a "front" side of the image forming apparatus 100, and a side thereof in a direction of pushing the feed cassette 306 is defined as a "rear" side of the image forming apparatus 100. Moreover, a right side of the image forming apparatus 100 when the "rear" side is viewed from the "front" side is defined as "right", and a left side of the image forming apparatus 100 when the "rear" side is viewed from the "front" side is defined as "left." Note that, in FIG. 9, the "front" side of the image forming apparatus 100 is a near side of FIG. 9, and the "rear" side of the image forming apparatus 100 is a far side of FIG. 9.

With reference to FIG. 9, a description is given of the configuration and image forming process of the image forming apparatus 100. The optical scanning device 101 is disposed vertically below a photosensitive drum 301 of each image forming unit, and radiates laser lights Ly, Lm, Lc, and Lk, which correspond to image data, to photosensitive drums 301*y*, 301*m*, 301*c*, and 301*k* of image forming units. The photosensitive drum 301 of each image forming unit is charged in advance to a uniform potential by a charging roller 302, and charges are released only from portions irradiated with the laser light emitted from the optical scanning device 101. In this way, an electrostatic latent image is formed on the surface of the photosensitive drum 301. Toner is caused to adhere to the electrostatic latent image on each photosensitive drum 301 by each developing roller 303, and the toner image is formed. A primary transfer roller 304 is disposed at a position facing each photosensitive drum 301, and a transfer voltage is applied to the primary transfer roller 304. Accordingly, the toner image on each photosensitive drum 301 is sequentially transferred in superimposition onto an intermediate transfer belt 305.

Meanwhile, recording materials 307 which are placed into a feed cassette 306 disposed vertically below the optical scanning device 101 are fed from the feed cassette 306 by a pickup roller 308 in synchronization with the above-mentioned image forming process of each image forming unit. Each of the recording materials 307 fed from the feed cassette 306 is conveyed to a secondary transfer roller 309. Then, the four-color toner images transferred onto the intermediate transfer belt 305 are transferred to the recording material 307 by the secondary transfer roller 309. The recording materials 307 onto which the toner images are transferred is conveyed to a fixing device 310, and is heated and pressed in the fixing device 310. Accordingly, the toner images are fixed to the recording materials 307. After that, the recording material 307 that has passed through the fixing device 310 is delivered to the outside of the image forming apparatus 100 by a delivery roller 311.

[Optical Scanning Device]

Figure 10:
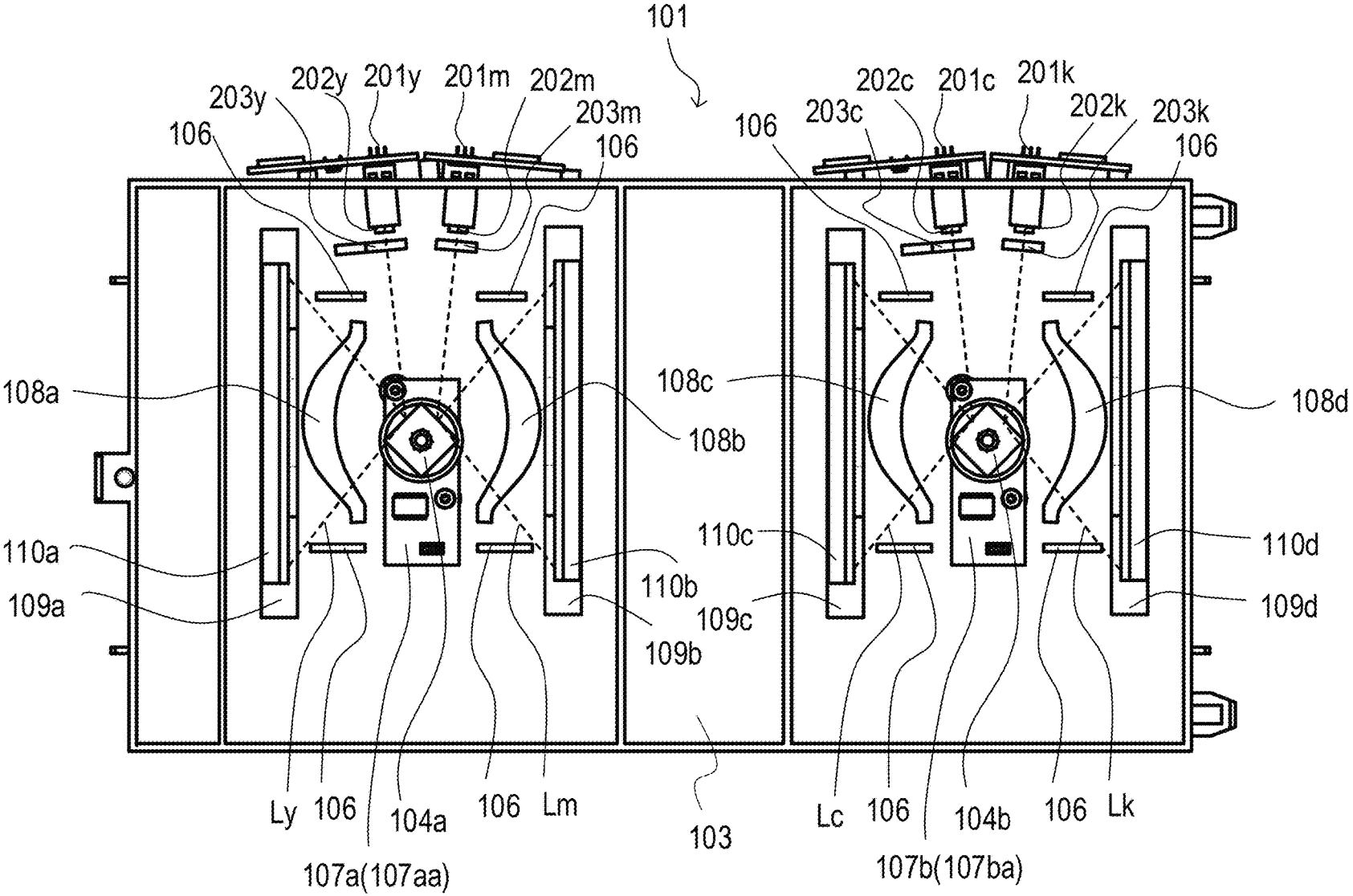
FIG. 10 is a view for illustrating a configuration of an optical scanning device of the second embodiment.
Figure 11:
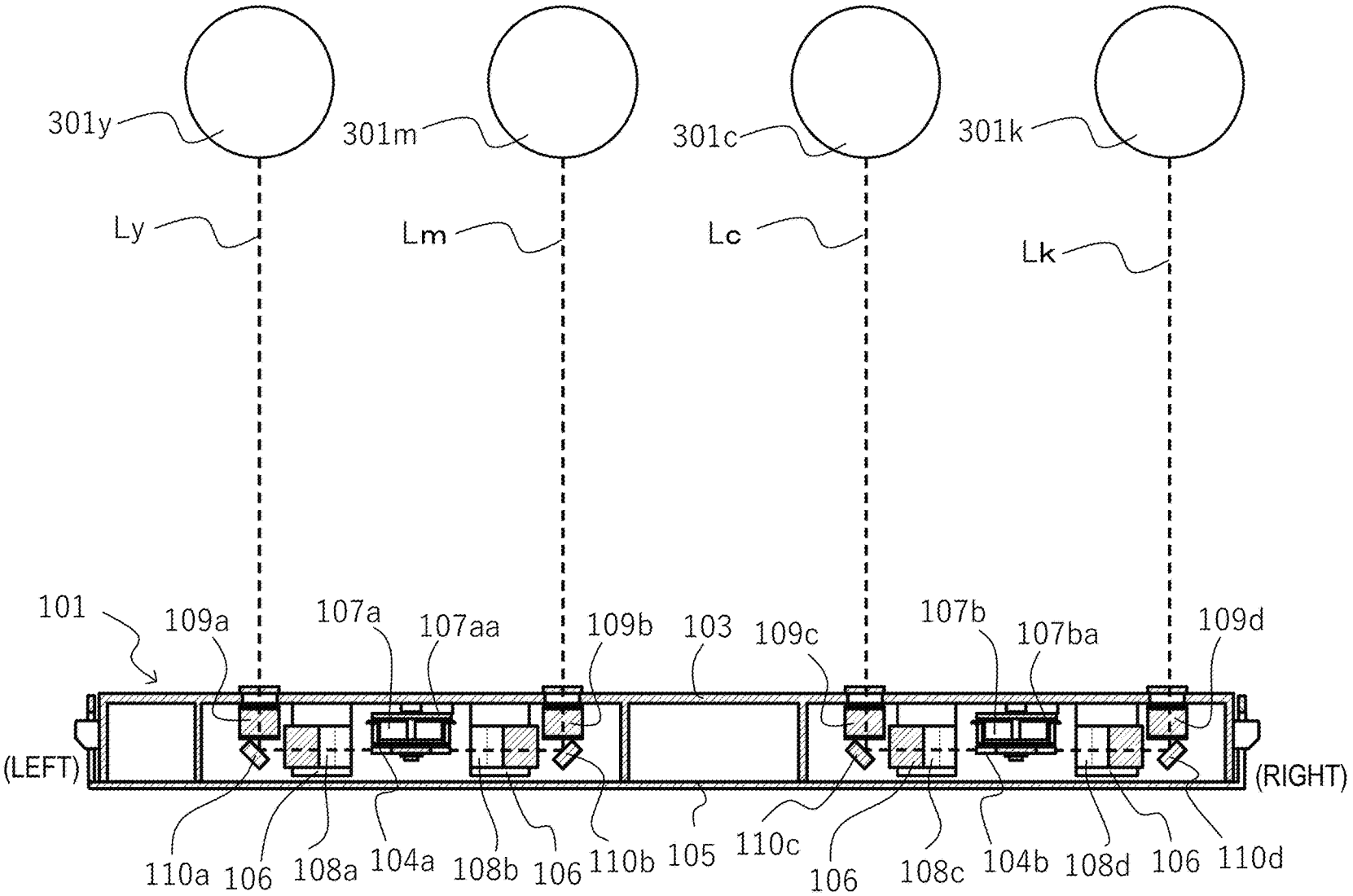
FIG. 11 is a schematic sectional view for illustrating the configuration of the optical scanning device of the second embodiment.

FIG. 10 and FIG. 11 are explanatory views for illustrating a configuration of the optical scanning device 101. FIG. 10 is a view for illustrating a configuration of the optical scanning device 101 when the optical scanning device 101 in a state in which a cover member 105 that covers an opening portion of the optical scanning device 101 is detached is viewed from the cover member 105 (the opening portion). Further, FIG. 11 is an explanatory schematic sectional view for illustrating the configuration of the optical scanning device 101 and a correlation between photosensitive drums 301 and laser lights emitted from the optical scanning device 101.

The optical scanning device 101 of this embodiment deflects the laser lights L emitted from semiconductor lasers 201, which are a plurality of light sources, by rotary polygon mirrors 104 provided in deflectors 107, and radiates the laser lights L to the plurality of corresponding photosensitive drums 301 through optical members. The optical scanning device 101 includes semiconductor lasers 201*y*, 201*m*, 201*c*, and 201*k*, collimator lenses 202*y*, 202*m*, 202*c*, and 202*k*, and cylindrical lenses 203*y*, 203*m*, 203*c*, and 203*k*. Moreover, the optical scanning device 101 includes: deflectors 107*a* and 107*b* having rotary polygon mirrors 104*a* and 104*b*; and first imaging lenses 108*a*, 108*b*, 108*c*, and 108*d* and second imaging lenses 109*a*, 109*b*, 109*c*, and 109*d*, which are imaging members of the laser lights. Further, the optical scanning device 101 includes: reflecting mirrors 110*a*, 110*b*, 110*c*, and 110*d* which are reflection members; an optical box 103 to be attached with the above-mentioned optical members; and a cover member 105 for tightly closing the optical box 103.

The optical box 103 is disposed vertically below the above-mentioned image forming units, and the cover member 105 is disposed vertically below the optical scanning device 101. That is, the cover member 105 is disposed so as to face the feed cassette 306 rather than to the optical box 103. In the deflectors 107*a* and 107*b*, drive circuit boards 107*aa* and 107*ba* for rotationally driving the rotary polygon mirrors 104*a* and 104*b* are fixed close to a bottom surface of the optical box 103, and the rotary polygon mirrors 104*a* and 104*b* are disposed vertically below the drive circuit boards 107*aa* and 107*ba*.

Further, in FIG. 10, backup portions 106 which are rib portions are installed near longitudinal ends of the first imaging lenses 108*a*, 108*b*, 108*c*, and 108*d*. The backup portions 106 are provided upright toward the cover member 105 from the bottom surface of the optical box 103, and have a length of about 1 mm as a clearance (distance) between the cover member 105 and distal end portions of the backup portions 106 themselves, which are close to the cover member 105. Accordingly, the optical components (for example, the first imaging lenses 108) inside the optical scanning device 101, which are arranged with a clearance larger than the clearance of the backup portions 106 with the cover member 105, can be prevented from directly coming into contact with the cover member 105.

Next, operations of the optical scanning device 101 are described. The laser light Ly emitted from the semiconductor laser 201*y* is converted into substantially parallel light by the collimator lens 202*y*, and enters the cylindrical lens 203*y*. Such a substantially parallel light flux that has entered the cylindrical lens 203*y* is emitted as it is in a state of the parallel light flux on a main scanning cross section, and on a sub-scanning cross section, the light flux is condensed, is caused to enter the rotary polygon mirror 104*a*, and is deflected by the rotary polygon mirror 104*a*. Then, the deflected laser light Ly passes through the first imaging lens 108*a*, and after that, a light path thereof is deflected by the reflecting mirror 110*a*. The laser light Ly that has the deflected light path passes through the second imaging lens 109*a* and an opening portion of the optical box 103, and scans the surface of the corresponding photosensitive drum 301*y* at a constant speed while forming spots on the photosensitive drum 301*y*.

The laser light Lm emitted from the semiconductor laser 201*m* is converted into substantially parallel light by the collimator lens 202*m*, and enters the cylindrical lens 203*m*. Such a substantially parallel light flux that has entered the cylindrical lens 203*m* is emitted as it is in a state of the parallel light flux on a main scanning cross section, and on a sub-scanning cross section, the light flux is condensed, is caused to enter the rotary polygon mirror 104*a*, and is deflected by the rotary polygon mirror 104*a*. Then, the deflected laser light Lm passes through the first imaging lens 108*b*, and after that, a light path thereof is deflected by the reflecting mirror 110*b*. The laser light Lm that has the deflected light path passes through the second imaging lens 109*b* and an opening portion of the optical box 103, and scans the surface of the corresponding photosensitive drum 301*m* at a constant speed while forming spots on the photosensitive drum 301*m*.

The laser light Lc emitted from the semiconductor laser 201*c* is converted into substantially parallel light by the collimator lens 202*c*, and enters the cylindrical lens 203*c*. Such a substantially parallel light flux that has entered the cylindrical lens 203*c* is emitted as it is in a state of the parallel light flux on a main scanning cross section, and on a sub-scanning cross section, the light flux is condensed, is caused to enter the rotary polygon mirror 104*b*, and is deflected by the rotary polygon mirror 104*b*. Then, the deflected laser light Lc passes through the first imaging lens 108*c*, and after that, a light path thereof is deflected by the reflecting mirror 110*c*. The laser light Lc that has the deflected light path passes through the second imaging lens 109*c* and an opening portion of the optical box 103, and scans the surface of the corresponding photosensitive drum 301*c* at a constant speed while forming spots on the photosensitive drum 301*c*.

The laser light Lk emitted from the semiconductor laser 201*k* is converted into substantially parallel light by the collimator lens 202*k*, and enters the cylindrical lens 203*k*. Such a substantially parallel light flux that has entered the cylindrical lens 203*k* is emitted as it is in a state of the parallel light flux on a main scanning cross section, and on a sub-scanning cross section, the light flux is condensed, is caused to enter the rotary polygon mirror 104*b*, and is deflected by the rotary polygon mirror 104*b*. Then, the deflected laser light Lk passes through the first imaging lens 108*d*, and after that, a light path thereof is deflected by the reflecting mirror 110*d*. The laser light Lk that has the deflected light path passes through the second imaging lens 109*d* and an opening portion of the optical box 103, and scans the surface of the corresponding photosensitive drum 301*k* at a constant speed while forming spots on the photosensitive drum 301*k*. Note that the laser lights Ly and Lm are deflected by surfaces of the rotary polygon mirror 104*a*, the surfaces being adjacent to and different from each other. Further, the laser lights Lc and Lk are also deflected by surfaces of the rotary polygon mirror 104*b*, the surfaces being adjacent to and different from each other.

[Replacement of Recording Material]

Figure 12:
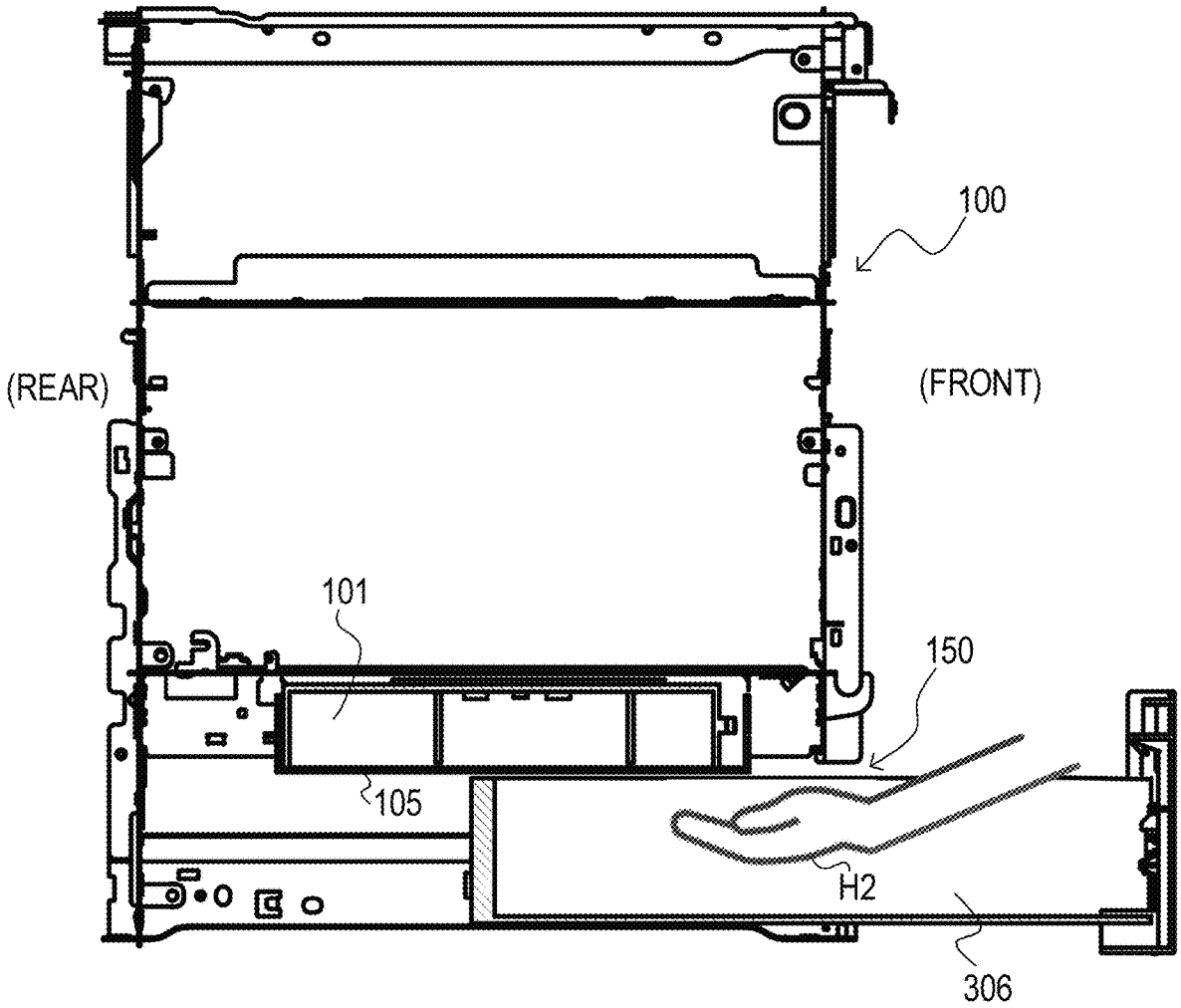
FIG. 12 is an explanatory view for illustrating a state in which a feed cassette of the second embodiment is drawn out.

FIG. 12 is an explanatory view for illustrating a method of replacing the recording materials in the image forming apparatus 100 of the second embodiment. When a printing job is executed, an image forming operation is performed in the above-mentioned image forming unit, and image formation is performed for recording materials 307 fed from the feed cassette 306. Accordingly, the recording materials 307 housed in the feed cassette 306 are consumed. Then, when a remaining amount of the recording materials 307 in the feed cassette 306 becomes small, or when all the recording materials 307 are consumed, the feed cassette 306 is refilled with recording materials 307 by a user or the like. As illustrated in FIG. 12, in this embodiment, the feed cassette 306 is refilled with the recording materials 307 by drawing out the feed cassette 306 of a draw-out type forward of the image forming apparatus 100.

FIG. 12 is a schematic sectional view for illustrating a half-way state in which the feed cassette 306 moves from a housing position of being mounted on the image forming apparatus 100 to the drawn-out position of being drawn out to the outside from the image forming apparatus 100. The feed cassette 306 is placed on a holding rail (not shown) so as to be slidable in the front-and-rear direction of the image forming apparatus 100. When being refilled with the recording materials 307, the feed cassette 306 is operated to be drawn out to the outside (front side in FIG. 12) of the image forming apparatus 100. When the feed cassette 306 is drawn out by a predetermined amount from the image forming apparatus 100 to the outside, a further movement thereof to be drawn out is restricted by a stopper portion (not shown). In such a state as described above where the feed cassette 306 is drawn out, the feed cassette 306 can be refilled with the recording materials 307, or the recording materials 307 can be taken out of the feed cassette 306 in order to change a type of the recording materials 307. Further, when receiving force in a direction of being further drawn out to the outside from the position at which the movement to be drawn out is restricted, the feed cassette 306 can be detached from the holding rail on which the feed cassette 306 is placed. Such detachment of the feed cassette 306 from the holding rail is performed, for example, in the case of further facilitating the work of refilling the feed cassette 306 with the recording materials, and in the case of removing a jammed sheet when there occurs jamming where the recording material 307 is caught in a conveyance path during image formation. Then, the refilling of the feed cassette 306 with the recording materials 307 or the removal processing for the jammed sheet from the conveyance path is ended, the feed cassette 306 is moved on the holding rail to the housing position of being mounted on the image forming apparatus 100 from the drawn-out position or the detached position after being placed on the holding rail.

Then, after moving to a pushed-in position, the feed cassette 306 is fixed to a predetermined position, where the image formation is enabled.

As illustrated in FIG. 9, the optical scanning device 101 is disposed vertically below the respective image forming units and vertically above the feed cassette 306 that houses the recording materials 307. Then, for the purpose of downsizing the image forming apparatus 100, no partition is provided between the optical scanning device 101 and the feed cassette 306. The feed cassette 306 is formed of a frame-shaped mold member. When the feed cassette 306 is drawn out of the image forming apparatus 100 as illustrated in FIG. 12, a vertically upper portion of the feed cassette 306 is opened, and an opening portion 150 appears. Accordingly, a person can insert a hand H2 from the opening portion 150, and there is a fear in that the hand H2 incorrectly touches the cover member 105 of the optical scanning device 101 to press the cover member 105.

[Mounting of Cover Member of Optical Scanning Device]

Figure 13:
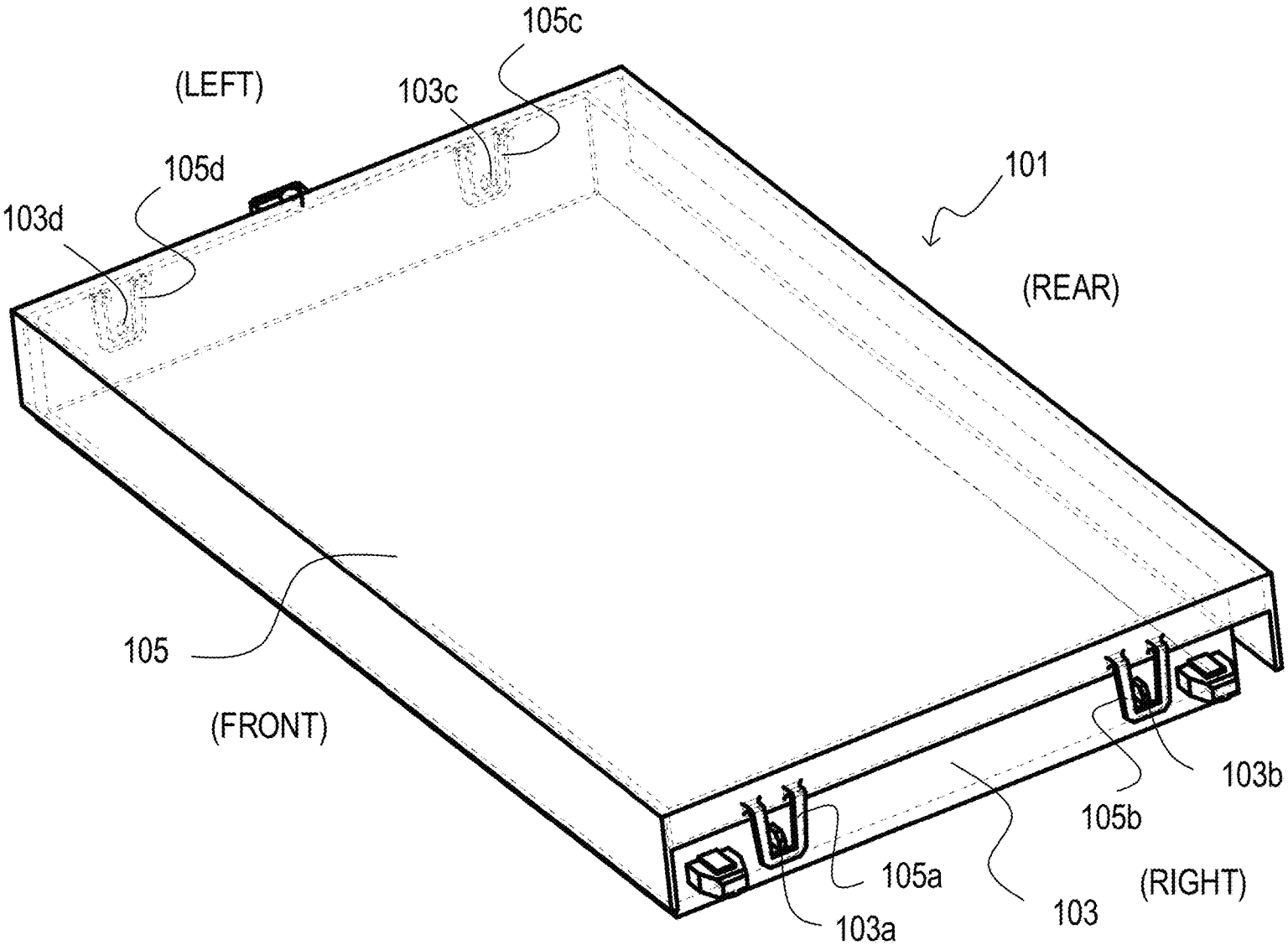
FIG. 13 is an explanatory view for illustrating a method of fixing a cover member of the optical scanning device of the second embodiment.

FIG. 13 is an explanatory schematic view for illustrating a method of fixing the cover member 105 to the optical scanning device 101. As illustrated in FIG. 11, in the optical scanning device 101, the optical box 103 is disposed on a vertically upper side, and the cover member 105 is disposed on a vertically lower side. FIG. 13 is a perspective view for illustrating an outer shape of the optical scanning device 101 when the optical scanning device 101 is viewed from the cover member 105.

In order to fix the cover member 105 to the optical box 103, the cover member 105 includes snap-fit structures 105*a*, 105*b*, 105*c*, and 105*d* molded integrally with the cover member 105. Each of the snap-fit structures 105*a*, 105*b*, 105*c*, and 105*d* has a square shape in which a center portion is opened. Meanwhile, protruding portions 103*a*, 103*b*, 103*c*, and 103*d* for fixing the cover member 105 are provided near four corners of the optical box 103 of the optical scanning device 101.

When the cover member 105 is assembled to the optical box 103, the respective snap-fit structures 105*a* to 105*d* elastically bend, and thereby get over the respective protruding portions 103*a* to 103*d* provided in the optical box 103 and corresponding to the respective snap-fit structures 105*a* to 105*d*. Further, the protruding portions 103*a* to 103*d* engage with the opening portions of the respective snap-fit structures 105*a* to 105*d*. As a result, the protruding portions 103*a*, 103*b*, 103*c*, and 103*d* protrude from the opening portions of the snap-fit structures 105*a*, 105*b*, 105*c*, and 105*d*. Accordingly, the cover member 105 is fixed to the optical box 103.

[Deformation of Cover Member of Optical Scanning Device]

Figure 14:
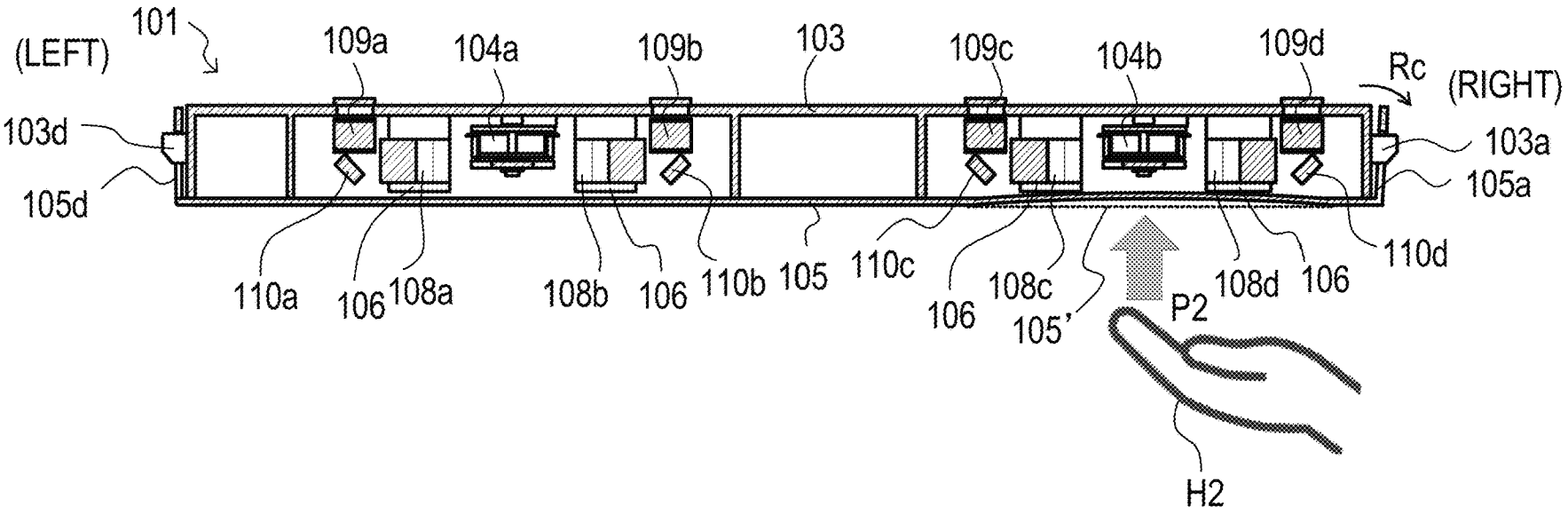
FIG. 14 is an explanatory view for illustrating deformation of the cover member of the optical scanning device of the second embodiment.

FIG. 14 is an explanatory sectional view of the optical scanning device 101, for illustrating a state of deformation of the cover member 105 when the person's hand H2 touches the cover member 105 of the optical scanning device 101. FIG. 14 is a sectional view of the optical scanning device 101, which is taken along vicinities of positions where the protruding portions 103*a* and 103*d* engage with the snap-fit structures 105*a* and 105*d*, respectively in a state in which the cover member 105 illustrated in FIG. 13 is fixed to the optical scanning device 101, as viewed rearward from the front side of the optical scanning device 101. In FIG. 14, from the cross section, illustrated are the rotary polygon mirrors 104*a* and 104*b*, the first imaging lenses 108*a* to 108*d*, the second imaging lenses 109*a* to 109*d* and the reflecting mirrors 110*a* and 110*d*, through which the laser lights Ly, Lm, Lc and Lk pass. Further, near the first imaging lenses 108*a* to 108*d*, provided are the backup portions 106 in which a clearance (distance) from distal end portions to the cover member 105 is smaller than those of the first imaging lenses 108*a* to 108*d* and the reflecting mirrors 110*a* to 110*d* to the cover member 105.

As illustrated in FIG. 14, when the hand H2 is inserted from the opening portion 150 (FIG. 12) and touches the cover member 105 at the time of refilling the feed cassette 306 with the recording materials 307 or replacement of the recording materials 307, pressing force P2 of 5 N to 20 N is applied to the cover member 105 toward the optical box with reference to pressing force of ordinary persons. When the cover member 105 is bent by the pressing force P2, the snap-fit structures 105*a* and 105*d* provided on the cover member 105 (the snap-fit structures 105*b* and 105*c* are not illustrated in FIG. 14) are elastically deformed in a direction of an arrow Rc in FIG. 14. In addition, the cover member 105 is deformed inward of the optical box 103 from an original position 105' (illustrated by a dotted line in FIG. 14), and comes into contact with the backup portions 106 for restricting the deformation, the backup portions 106 being provided in the optical box 103. As mentioned above, the backup portions 106 are provided near the optical components (for example, the first imaging lens 108) arranged in the optical box 103. The backup portions 106 have a length of about 1 mm as a clearance (distance) between the cover member 105 and the distal end portions of the backup portions 106 themselves, which are close to the cover member 105. Accordingly, the optical components (for example, the first imaging lenses 108 and the like) inside the optical scanning device 101, which are arranged with a clearance larger than the clearance of the backup portions 106 with the cover member 105, can be prevented from directly coming into contact with the cover member 105.

As mentioned above, even when the person's hand H2 touches the optical scanning device 101 at the time of moving the feed cassette 306 to the outside of the image forming apparatus 100 during refilling of the feed cassette 306 with the recording materials or replacement of the recording materials, optical characteristics of the optical components do not change or image quality therefrom does not degrade due to fluctuations in the postures of the optical components.

In this embodiment, the description has been given of the configuration in which the backup portions 106 for reducing the bending that occurs when the person's hand H2 touches the cover member 105 is provided in the optical box 103. Note that the backup portions 106 are not limited to those provided on the optical box 103, and the backup portions 106 may be provided on the cover member 105. That is, on a surface of the cover member 105, which faces the bottom surface of the optical box 103 in which the optical members are arranged, the backup portions 106 are provided. The backup portions 106 are provided upright toward the bottom surface of the optical box 103, and have distal end portions having a length of about 1 mm as a clearance with the bottom surface of the optical box 103. Thus, even when the cover member 105 is pressed toward the optical box 103, the backup portions 106 provided on the cover member 105 come into contact with the bottom surface of the optical box 103 before the cover member 105 comes into contact with the optical members. Thus, even when the backup portions 106 are provided on the cover member 105, similar effects to those in the case in which the backup portions 106 are provided on the optical box 103 can be achieved. Moreover, in FIG. 14, the description has been given of the case in which the person's hand H2 comes into contact with the vicinity of the deflector 107*b* of the optical scanning device 101 with regard to the position of the cover member 105, which is in contact with the person's hand H2. However, similar effects can be achieved even when the person's hand H2 comes into contact with the vicinity of the other deflector 107*a*.

As described above, according to this embodiment, the image quality can be prevented from being degraded by the fact that the optical box is pressed.

Third Embodiment

In the first and second embodiments, the description has been given of the backup portions which are rib portions for protecting the optical components and the like arranged in the optical scanning device when the cover member of the optical scanning device is pressed. Herein, the optical components and the like are protected so as to be prevented from coming into contact with the cover member bent by being pressed. In a third embodiment, a description is given of processing and material of the cover member for protecting, from static electricity, electronic devices in the optical scanning device including the backup portions as described above.

[Cover Member of Optical Scanning Device]

Figure 15:
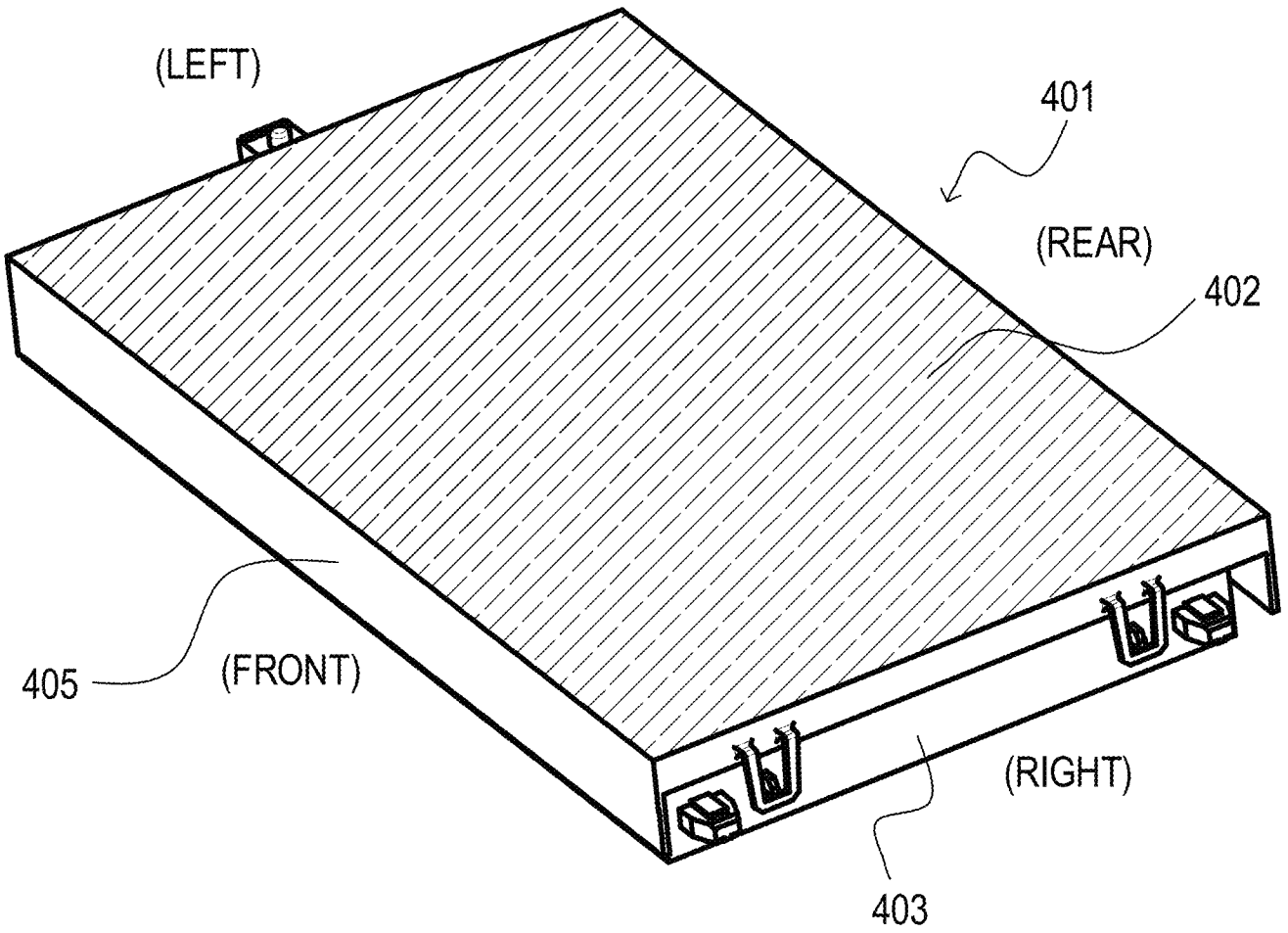
FIG. 15 is an explanatory view for illustrating a cover member of an optical scanning device of a third embodiment.

FIG. 15 is a perspective view of an optical scanning device 401 having an outer shape similar to that of the optical scanning device 101 described in the second embodiment. The optical scanning device 401 includes an optical box 403 and a cover member 405, and FIG. 15 is a perspective view when the optical scanning device 401 in which an opening portion of the optical box 403 is tightly closed by the cover member 405 is viewed from a direction of the cover member 405.

The cover member 405 of this embodiment is molded from a resin, and a flat-surface region 402 that is an outer surface touchable by the person's hand H2 described in the second embodiment is roughened by emboss processing. Herein, the flat-surface region 402 is a surface opposite to a surface of the cover member 405, which faces the optical box 403. The emboss processing is performed by using a processing method such as etching, sandblasting and hairline finish, and in FIG. 15, the roughened flat-surface region 402 is illustrated by hatching. In general, when two substances come into contact with each other, and then separate from each other, then atoms formed of the respective substances move and remain in one of the substances. Accordingly, electrons are biased to the one of the substances, and electrons of another substances decrease. In particular, as a frictional force when two substances come into contact with each other is larger, the amount of static electricity charged to the substances increases. As mentioned above, when the person's hand touches the cover member 405 of the optical scanning device 401, and the optical scanning device 401 is charged with static electricity, frictional force between the cover member 405 and the person's hand decreases as roughness of the roughened surface provided on the flat-surface region 402 of the cover member 405 is larger. As a result, a charge amount of the cover member 405 also decreases.

Further, the cover member 405 is made of a resin, and for a material of the resin, a static electricity diffusing material with an electrical resistivity of $1\times10^{11}$ ohm-meter (Ω·m) or less is used. Such a resin material for use in the cover member 405 of this embodiment is difficult to charge because the electrical resistivity thereof is high. Further, even when the resin material is brought into contact with a charged object (person's hand), the resin material can dissipate the charges relatively rapidly. As a result, in the cover member 405, intense electrostatic discharge (ESD) does not occur, and accordingly, ICs in a laser driver, a motor driver, a BD sensor, and the like inside the optical scanning device 401 can be protected from the electrostatic discharge. Thus, the image quality can be prevented from being degraded due to IC breakage and the like.

In this embodiment, the description has been given of the configuration in which the outer surface of the cover member 405 is entirely formed of a flat surface, and the flat surface is entirely roughened by the emboss processing. For example, when the cover member 405 has irregularities and cannot be formed of a single flat surface, partial regions of the cover member 405, which are located near driver ICs for controlling the deflectors, are roughened. Accordingly, electric components sensitive to the discharge of static electricity can be protected from static electricity, and similar effects can be achieved. Note that, though the description has been given of this embodiment by using the optical scanning device 401 having a similar outer shape to that of the optical scanning device 101 of the second embodiment, similar emboss processing is performed for the cover member 5 also for the optical scanning device 2 of the first embodiment. Accordingly, similar effects can be achieved.

As mentioned above, according to this embodiment, the charge amount of the cover member can be reduced even when the person's hand inserted into the image forming apparatus touches the cover member of the optical scanning device at the time of replacement of the cartridge or refilling of the feed cassette with the recording materials. Accordingly, an optical scanning device including electronic components sensitive to the discharge of static electricity, the optical scanning device being resistant to a variety of ESD modes, can be provided.

Further, in each of the above-mentioned first and second embodiments, the description has been given of the present disclosure by using the optical scanning device for use in such an image forming apparatus of a system called an inline system in which a plurality of process cartridges are arrayed. Similarly, the present disclosure is also applicable to an optical scanning device of a monochrome image forming apparatus including a single process cartridge.

As described above, according to this embodiment, the image quality can be prevented from being degraded by the fact that the optical box is pressed.

Figure 16:
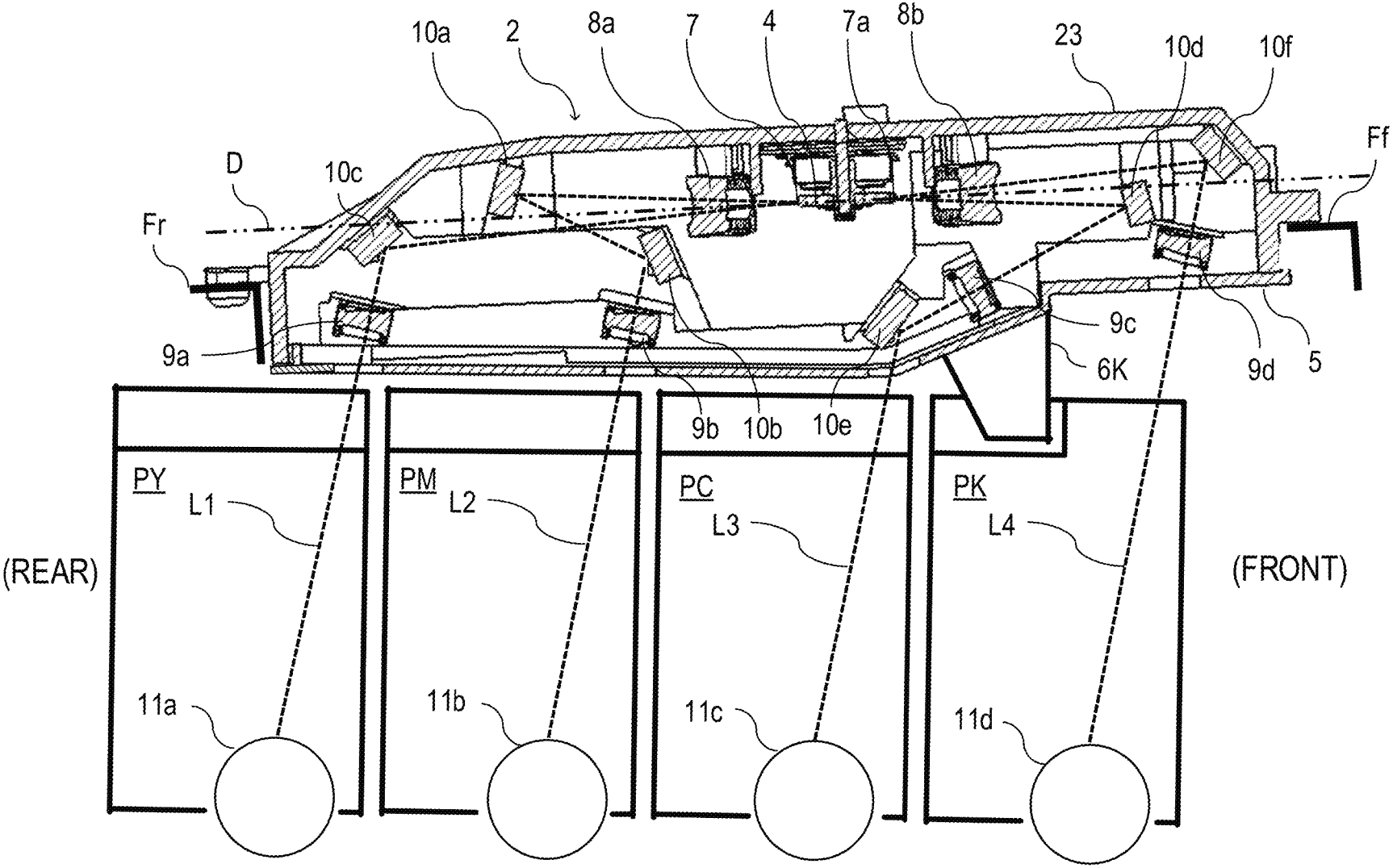
FIG. 16 is a schematic sectional view for illustrating a configuration of an optical scanning device of a fourth embodiment.

Subsequently, with reference to FIG. 16 to FIG. 19, a description is given of a fourth embodiment in which an incorrect mounting prevention mechanism of process cartridges is mounted. FIG. 16 is a schematic sectional view for illustrating a configuration of an optical scanning device of the fourth embodiment.

[Incorrect Mounting Prevention Mechanism of Process Cartridge PK]

[Case in which Respective Process Cartridges are Mounted on Regular Positions]

Figure 17:
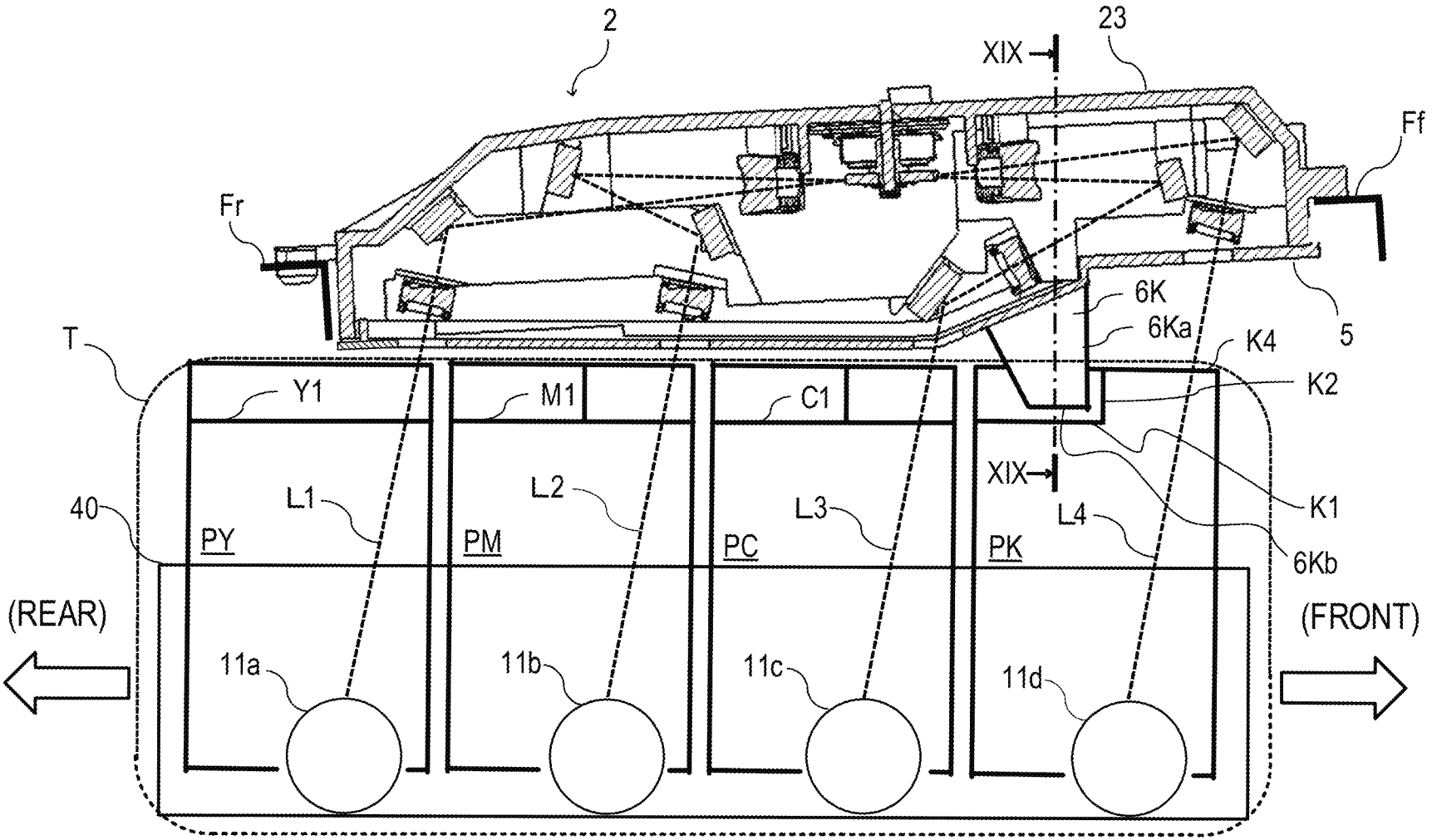
FIG. 17 is an explanatory view for illustrating incorrect mounting prevention mechanisms of process cartridges of the fourth embodiment.

FIG. 17 is a view for illustrating a state in which the cartridge tray 40 in which the respective process cartridges PY, PM, PC, and PK are mounted on regular positions is housed in a housing portion T (a region surrounded by a dotted line in FIG. 17) of the image forming apparatus 1. Note that, in FIG. 17, outlined arrows indicate a direction (a leftward arrow in FIG. 17) of housing the cartridge tray 40 and a direction (a rightward arrow in FIG. 17) of drawing out the cartridge tray 40. Note that the same also applies to outlined arrows in FIG. 18 and subsequent drawings. An incorrect mounting prevention mechanism of the process cartridge PK is formed of: incorrect mounting prevention portions 6K which are rib portions which are provided on the cover member 5 of the optical scanning device 2 and protrude toward the process cartridge PK; and a rib portion that is provided on a vertically upper portion of the process cartridge PK and faces the cover member 5. Note that FIG. 17 shows only the incorrect mounting prevention mechanism of the process cartridge PK, and does not show incorrect mounting prevention mechanisms of the process cartridges PM and PC, which are to be described later.

As illustrated in FIG. 17, the incorrect mounting prevention portions 6K provided on the cover member 5 have a trapezoidal shape when viewed from the left side of the image forming apparatus 1. Bottom surfaces 6Kb of the incorrect mounting prevention portions 6K, which face the process cartridge PK, are horizontal surfaces, and the incorrect mounting prevention portions 6K extend vertically below a top portion K4 that is a flat-surface portion of a rib portion K3 (see FIG. 19) of the process cartridge PK, the flat-surface portion being closest to the optical scanning device 2. Note that, as illustrated in FIG. 17, on upper portions of the process cartridges PY, PM and PC, the process cartridges PY, PM, and PC have rib portions, which face the cover member 5, similarly to the process cartridge PK. Then, on the process cartridges PY, PM, and PC, top surface portions Y1, M1, and C1 are formed, respectively at a height that is lower than the top portions of the rib portions of the respective process cartridges and does not allow the bottom surfaces 6Kb of the incorrect mounting prevention portions 6K to come into contact with the top surface portions. Accordingly, in a process in which the cartridge tray 40 is inserted into the image forming apparatus 1, the respective process cartridges PY, PM, and PC do not come into contact with the incorrect mounting prevention portions 6K, and the cartridge tray 40 is housed to a regular position of the housing portion T. As with the other process cartridges PY, PM, and PC, also on the process cartridge PK, top surface portions K1 are formed at a height that is lower than the top portions of the rib portions of the process cartridge and does not allow the bottom surfaces 6Kb of the incorrect mounting prevention portions 6K to come into contact with the top surface portions. However, each of the top surface portions K1 of the process cartridge PK is disconnected by an interference wall K2, which is a wall portion provided upright on a vertically upper portion toward the cover member 5, on a half way on a downstream side in a direction where the cartridge tray 40 is inserted. Note that, as illustrated in FIG. 17, when the process cartridge PK is mounted on the regular position of the cartridge tray 40, a gap is present between each of collision walls 6Ka of the incorrect mounting prevention portions 6K and each of the interference walls K2, between which no contact is allowed.

[Case in which Process Cartridge PK is incorrectly Mounted]

Figure 18:
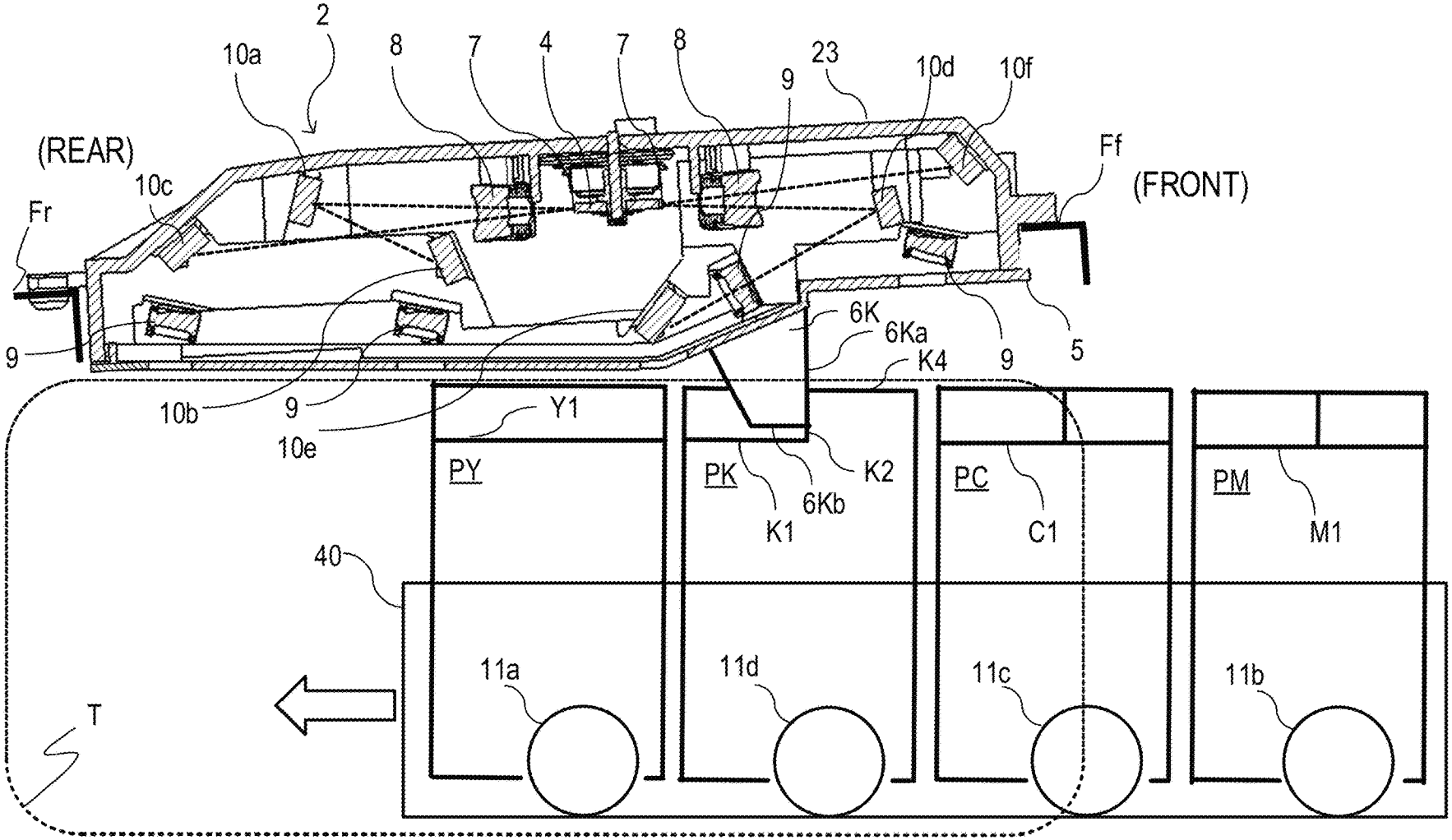
FIG. 18 is an explanatory view for illustrating an incorrect mounting state of the process cartridge PK of the fourth embodiment.

Next, a description is given of a case in which the process cartridge PK is incorrectly mounted. FIG. 18 is an explanatory view for illustrating incorrect mounting of the process cartridge PK as an example of such incorrect mounting, that is, a state in which the cartridge tray 40 is inserted into the image forming apparatus 1 in a state in which the process cartridge PK is mounted on the position of the process cartridge PM. Note that, in FIG. 18, the process cartridge PK is mounted on the position of the process cartridge PM, and hence the process cartridge PM is mounted on the position of the process cartridge PK. When the cartridge tray 40 is gradually inserted in the state in which the process cartridge PK is mounted on the position of the process cartridge PM, the top surface portions Y1 of the process cartridge PY mounted on the regular position is lower than bottom surfaces 6Kb of the incorrect mounting prevention portions 6K. Accordingly, the process cartridge PY passes through the incorrect mounting prevention portions 6K without coming into contact with the incorrect mounting prevention portions 6K. Then, when the cartridge tray 40 is further inserted into the image forming apparatus 1, the collision walls 6Ka of the incorrect mounting prevention portions 6K come into contact with the interference walls K2 of the process cartridge PK mounted on the position of the process cartridge PM. The collision walls 6Ka of the incorrect mounting prevention portions 6K are in contact with the interference walls K2 of the process cartridge PK, and hence the cartridge tray 40 is prevented from being inserted into the image forming apparatus 1 any more. As described above, by the incorrect mounting prevention mechanism of this embodiment, the user can grasp that the process cartridge is incorrectly mounted, and the cartridge tray 40 is prevented from being housed into the housing portion T.

[Configuration of Incorrect Mounting Prevention Mechanism of Process Cartridge PK]

Figure 19:
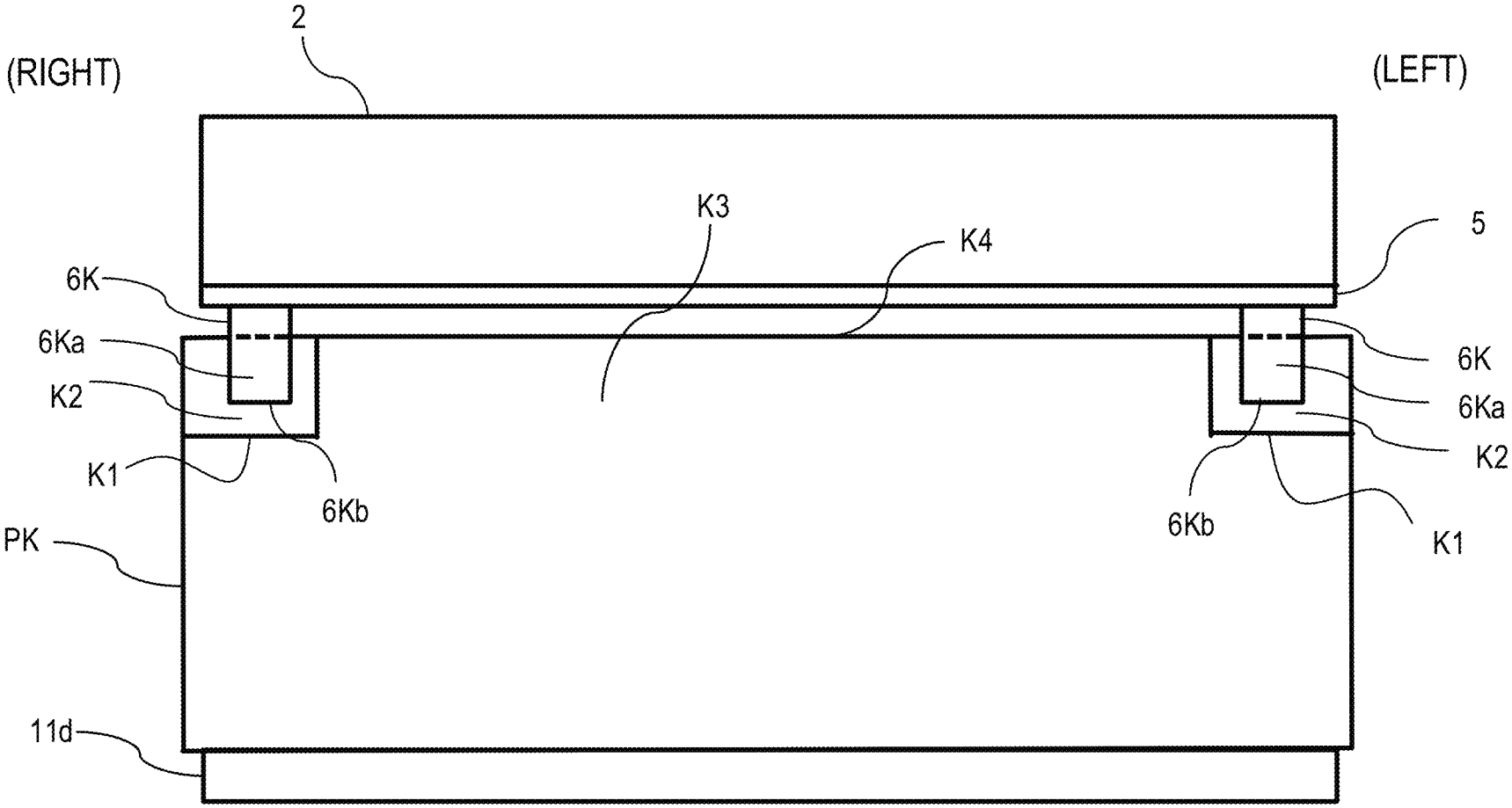
FIG. 19 is an explanatory view for illustrating the incorrect mounting prevention mechanism of the process cartridge PK of the fourth embodiment.

FIG. 19 is an explanatory schematic view for illustrating configurations of the incorrect mounting prevention portions 6K and the rib portion K3 of the process cartridge PK, for illustrating cross sections of the optical scanning device 2 and the process cartridge PK, which are taken along a line XIX-XIX illustrated in FIG. 17. Note that FIG. 19 is a schematic view when the optical scanning device 2 and the process cartridge PK are viewed forward from the rear side of the image forming apparatus 1 in FIG. 17.

In FIG. 19, the incorrect mounting prevention portions 6K of the cover member 5 are provided at positions of the optical scanning device 2, which face vicinities of both end portions in a longitudinal direction of the process cartridge PK (the longitudinal direction is also a direction perpendicular to a moving direction of the cartridge tray 40). Further, the interference walls K2 are provided at positions of the process cartridge PK, which correspond to the incorrect mounting prevention portions 6K. Meanwhile, the process cartridge PK includes, in the vertically upper portion thereof facing the optical scanning device 2: the recessed top surface portions K1 provided on both sides in the longitudinal direction (right-and-left direction in FIG. 19); and the rib portion K3 having the interference walls K2 provided upright from the top surface portion K1. Moreover, the rib portion K3 has the top portion K4 that faces the optical scanning device 2. Although not shown, when the rib portion K3 of the process cartridge PK is viewed from the optical scanning device 2 facing the same, a shape of the rib portion K3 can also be said to be a T shape in which a center bar portion is wide. Then, when the process cartridge PK is incorrectly mounted, the collision walls 6Ka of the incorrect mounting prevention portions 6K are configured to come into contact with the interference walls K2 of the process cartridge PK. In FIG. 18, the description has been given of the case in which the process cartridge PK is mounted incorrectly for the process cartridge PM. Even when the process cartridge PK is incorrectly mounted on the mounting positions of the process cartridges PC and PY, the collision walls 6Ka come into contact with the interference walls K2 of the incorrectly mounted process cartridge PK in the process of inserting the cartridge tray 40 into the image forming apparatus 1. Accordingly, the cartridge tray 40 is not housed in the housing portion T.

[Incorrect Mounting Prevention Mechanisms of Process Cartridges PM and PC]

The description has been given above of the incorrect mounting prevention mechanism that detects the incorrect mounting when the process cartridge PK is thus mounted incorrectly on the position of the other process cartridge on the cartridge tray 40. In this embodiment, similar incorrect mounting prevention mechanisms are provided also for the process cartridges PM and PC, and with reference to FIG. 20 to FIG. 24, a description is given of the incorrect mounting prevention mechanisms of the process cartridges PM and PC.

[Case in which Respective Process Cartridges are Mounted on Regular Positions]

Figure 20:
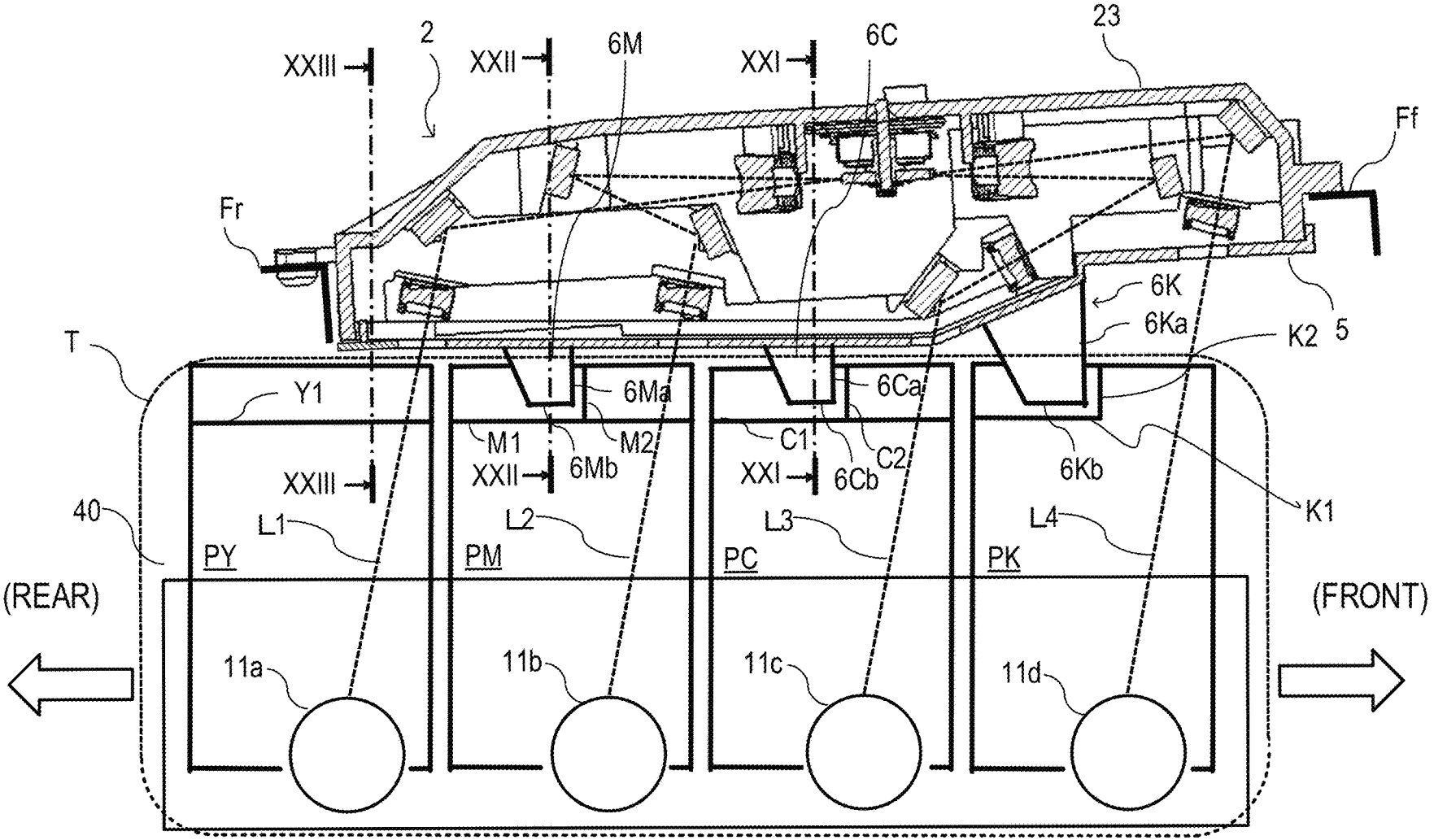
FIG. 20 is a view for illustrating a state in which a cartridge tray in which the process cartridges of the fourth embodiment are mounted at normal positions is housed.

FIG. 20 is a view for illustrating a state in which the cartridge tray 40 in which the respective process cartridges PY, PM, PC, and PK are mounted on the regular positions is housed in the housing portion T of the image forming apparatus 1.

In FIG. 20, the incorrect mounting prevention mechanism of the process cartridge PM is formed of: an incorrect mounting prevention portions 6M which protrude toward the process cartridge PM from the cover member 5 of the optical scanning device 2; and a rib portion M3 (see FIG. 22) provided on the upper portion of the process cartridge PM. As illustrated in FIG. 20, similarly to the incorrect mounting prevention portions 6K, the incorrect mounting prevention portions 6M have a trapezoidal shape when viewed from the left side of the image forming apparatus 1. Bottom surfaces 6Mb of the incorrect mounting prevention portions 6M, which face the process cartridge PM, are horizontal surfaces, and the incorrect mounting prevention portions 6M extend vertically below a top portion M4 (see FIG. 22) that is a flat-surface portion of a rib portion M3 of the process cartridge PM, the flat-surface portion being closest to the optical scanning device 2. On the process cartridge PM, top surface portions M1 are formed at a height that is lower than the top portion M4 of the rib portion of the process cartridge PM and does not allow the bottom surfaces 6Mb of the incorrect mounting prevention portions 6M to come into contact with the top surface portions. In the process cartridge PM, similarly to the process cartridge PK, a part of each of the top surface portions M1 is disconnected by an interference wall M2 provided upright on a vertically upper portion toward the cover member 5 on a half way on a downstream side in the direction where the cartridge tray 40 is inserted. Note that, as illustrated in FIG. 20, when the process cartridge PM is mounted on the regular position of the cartridge tray 40, a gap is present between each of collision walls 6Ma of the incorrect mounting prevention portions 6M and each of the interference walls M2, between which no contact is allowed.

Moreover, the incorrect mounting prevention mechanism of the process cartridge PC is formed of: incorrect mounting prevention portions 6C which protrude toward the process cartridge PC (toward the image forming unit) from the cover member 5 of the optical scanning device 2; and a rib portion C3 (see FIG. 21) provided on the upper portion of the process cartridge PC. As illustrated in FIG. 20, similarly to the incorrect mounting prevention portions 6M, the incorrect mounting prevention portions 6C have a trapezoidal shape when viewed from the left side of the image forming apparatus 1. Bottom surfaces 6Cb of the incorrect mounting prevention portions 6C, which face the process cartridge PC, are horizontal surfaces, and the incorrect mounting prevention portions 6C extend vertically below a top portion C4 (see FIG. 21) that is a flat-surface portion of a rib portion C3 of the process cartridge PC, the flat-surface portion being closest to the optical scanning device 2. On the process cartridge PC, top surface portions C1 are formed at a height that is lower than the top portion C4 of the rib portion of the process cartridge PC and does not allow the bottom surfaces 6Cb of the incorrect mounting prevention portions 6C to come into contact with the top surface portions. In the process cartridge PC, similarly to the process cartridge PM, a part of each of the top surface portions C1 is disconnected by an interference wall C2 provided upright on a vertically upper portion toward the cover member 5 on a half way on a downstream side in the direction where the cartridge tray 40 is inserted. Note that, as illustrated in FIG. 20, when the process cartridge PC is mounted on the regular position of the cartridge tray 40, a gap is present between each of collision walls 6Ca of the incorrect mounting prevention portions 6C and each of the interference walls C2, between which no contact is allowed.

[Configuration of Incorrect Mounting Prevention Mechanism of Process Cartridge PC]

Figure 21:
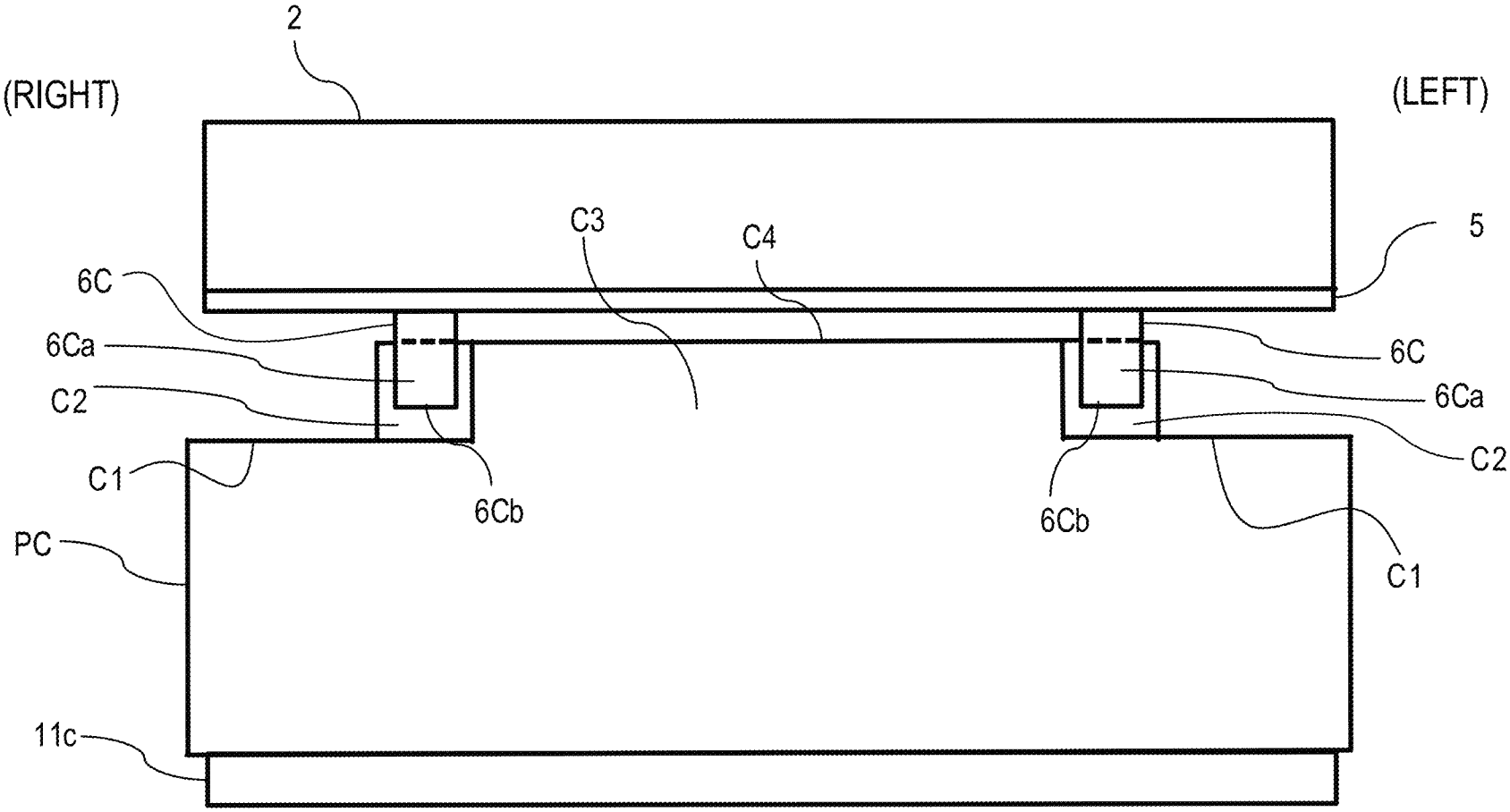
FIG. 21 is an explanatory view for illustrating the incorrect mounting prevention mechanism of the process cartridge PC of the fourth embodiment.

FIG. 21 is an explanatory schematic view for illustrating configurations of the incorrect mounting prevention portions 6C and the rib portion C3 of the process cartridge PC, for illustrating cross sections of the optical scanning device 2 and the process cartridge PC, which are taken along a line XXI-XXI illustrated in FIG. 20. Note that FIG. 21 is a schematic view when the optical scanning device 2 and the process cartridge PC are viewed forward from the rear side of the image forming apparatus 1 in FIG. 20.

In FIG. 21, the incorrect mounting prevention portions 6C of the cover member 5 are provided at positions of the optical scanning device 2, which are closer to the center than positions where the above-mentioned incorrect mounting prevention portions 6K are provided, in the longitudinal direction of the process cartridge PC. Further, the interference walls C2 are provided at positions of the process cartridge PC, which correspond to the incorrect mounting prevention portions 6C. As mentioned above, the process cartridge PC includes, in the vertically upper portion thereof facing the optical scanning device 2, the recessed top surface portions C1 provided on both sides in the longitudinal direction (right-and-left direction in FIG. 21). Further, the process cartridge PC includes the rib portion C3 having the interference walls C2 provided upright partially from the top surface portions C1 so as to come into contact with the collision walls 6Ca of the incorrect mounting prevention portions 6C. The rib portion C3 includes the top portion C4 facing the optical scanning device 2. Although not shown, when the rib portion C3 of the process cartridge PC is viewed from the optical scanning device 2 facing the same, a shape of the rib portion C3 can also be said to be a T shape in which a center bar portion is wide. Then, when the process cartridge PC is incorrectly mounted, the collision walls 6Ca of the incorrect mounting prevention portions 6C are configured to come into contact with the interference walls C2 of the process cartridge PC. Note that, in the rib portion C3 of the process cartridge PC, a width thereof in the longitudinal direction (right-and-left direction in FIG. 21) is shorter than that of the rib portion K3 of the process cartridge PK so that the collision walls 6Ka of the incorrect mounting prevention portions 6K are prevented from coming into contact with the rib portion C3.

[Configuration of Incorrect Mounting Prevention Mechanism of Process Cartridge PM]

Figure 22:
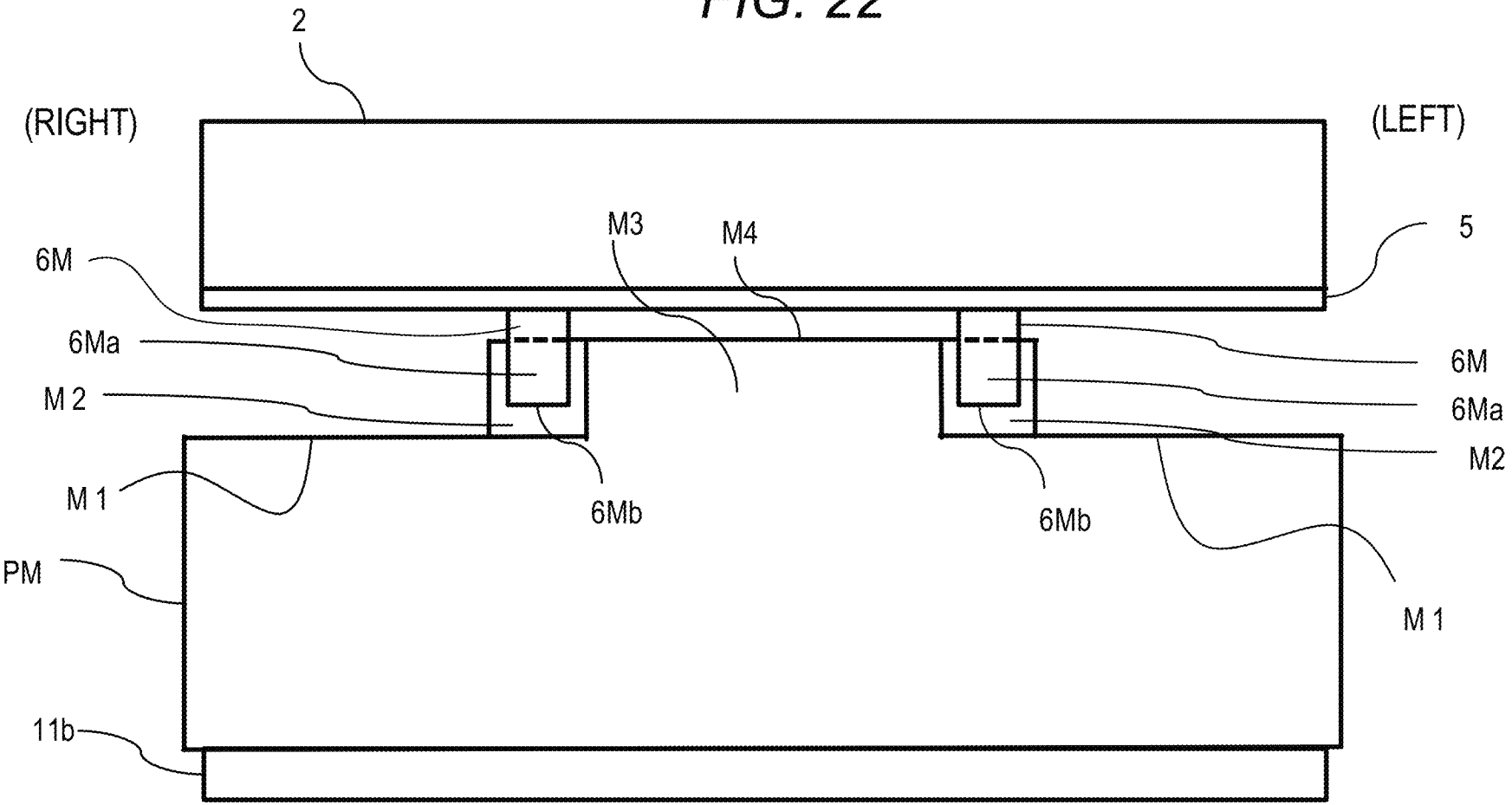
FIG. 22 is an explanatory view for illustrating the incorrect mounting prevention mechanism of the process cartridge PM of the fourth embodiment.

FIG. 22 is an explanatory schematic view for illustrating configurations of the incorrect mounting prevention portions 6M and the rib portion M3 of the process cartridge PM, for illustrating cross sections of the optical scanning device 2 and the process cartridge PM, which are taken along a line XXII-XXII illustrated in FIG. 20. Note that FIG. 22 is a schematic view when the optical scanning device 2 and the process cartridge PM are viewed forward from the rear side of the image forming apparatus 1 in FIG. 20.

In FIG. 22, the incorrect mounting prevention portions 6M of the cover member 5 are provided at positions of the optical scanning device 2, which are closer to the center than positions in which the above-mentioned incorrect mounting prevention portions 6C are provided, in the longitudinal direction of the process cartridge PM. Further, the interference walls M2 are provided at positions of the process cartridge PC, which correspond to the incorrect mounting prevention portions 6M. As mentioned above, the process cartridge PM includes, in the vertically upper portion thereof facing the optical scanning device 2, the recessed top surface portions M1 provided on both sides in the longitudinal direction (right-and-left direction in FIG. 22). Further, the process cartridge PM includes the rib portion M3 having the interference walls M2 provided upright partially from the top surface portions M1 so as to come into contact with the collision walls 6Ma of the incorrect mounting prevention portions 6M. The rib portion M3 includes the top portion M4 facing the optical scanning device 2. Although not shown, when the rib portion M3 of the process cartridge PM is viewed from the optical scanning device 2 facing the same, a shape of the rib portion M3 can also be said to be a T shape in which a center bar portion is wide. Then, when the process cartridge PM is incorrectly mounted, the collision walls 6Ma of the incorrect mounting prevention portions 6M are configured to come into contact with the interference walls M2 of the process cartridge PM. Note that, in the rib portion M3 of the process cartridge PM, a width thereof in the longitudinal direction (right-and-left direction in FIG. 22) is shorter than that of the rib portions K3 and C3 of the process cartridges PK and PC so that the collision walls 6Ka and 6Ca of the incorrect mounting prevention portions 6K and 6C are prevented from coming into contact with the rib portion M3.

[Configuration of Incorrect Mounting Prevention Mechanism of Process Cartridge PY]

Figure 23:
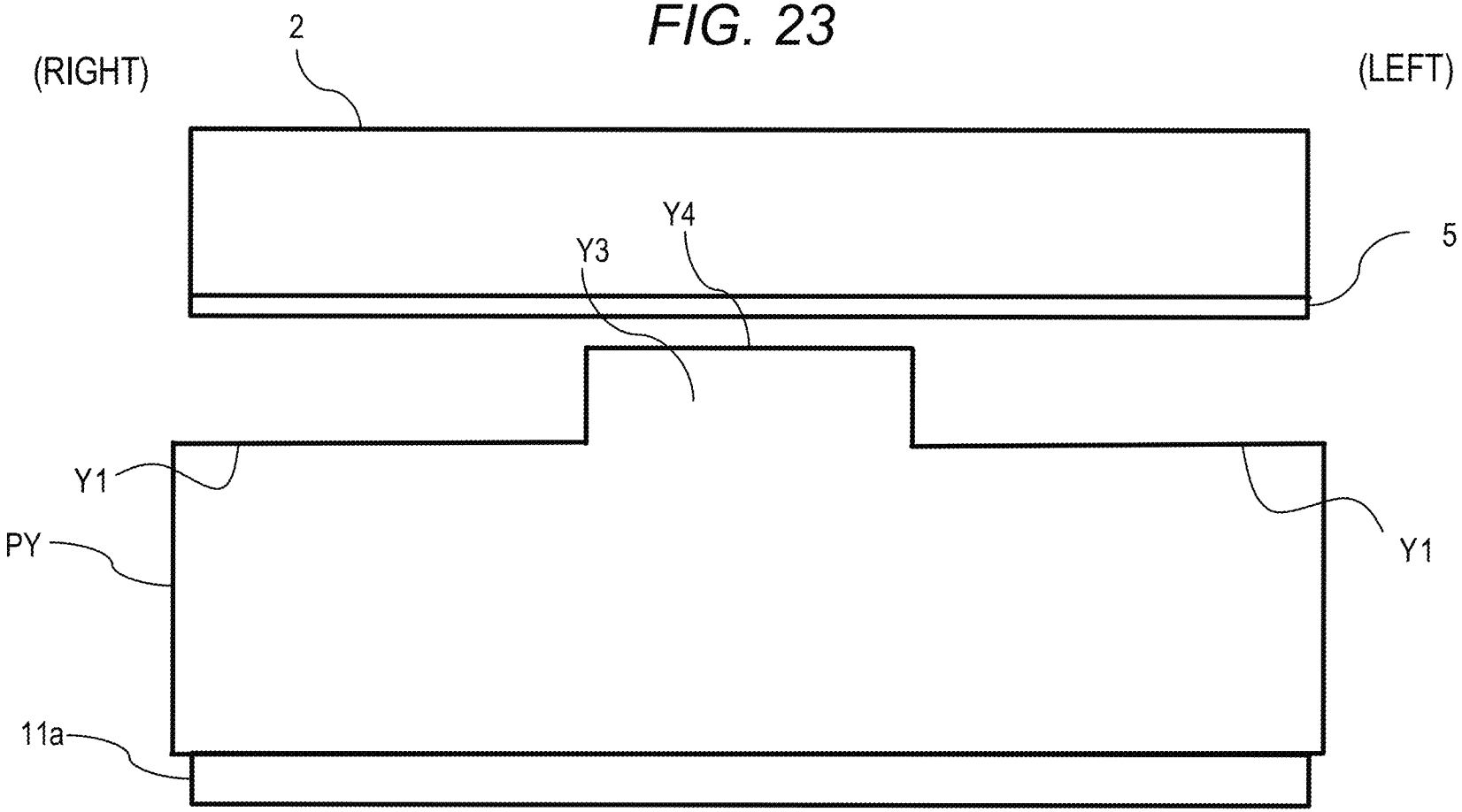
FIG. 23 is an explanatory view for illustrating the incorrect mounting prevention mechanism of the process cartridge PY of the fourth embodiment.

FIG. 23 is an explanatory schematic view for illustrating cross sections of the optical scanning device 2 and the process cartridge PY, which are taken along a line XXIII-XXIII illustrated in FIG. 20. Note that FIG. 23 is a schematic view when the optical scanning device 2 and the process cartridge PY are viewed forward from the rear side of the image forming apparatus 1 in FIG. 20.

In FIG. 23, the optical scanning device 2 is not provided with an incorrect mounting prevention mechanism for the process cartridge PY to be mounted on a foremost portion of the cartridge tray 40, such an incorrect mounting prevention mechanism being as the incorrect mounting prevention portions 6M, 6C, and 6K for the incorrect mounting prevention of the process cartridges PM, PC, and PK. The process cartridge PY includes, in the vertically upper portion thereof facing the optical scanning device 2: the recessed top surface portions Y1 in both sides in the longitudinal direction; and a rib portion Y3 provided upright from the top surface portions Y1. Moreover, the rib portion Y3 has a top portion Y4 that faces the optical scanning device 2. The optical scanning device 2 is not provided with the incorrect mounting prevention mechanism for the process cartridge PY, and hence the process cartridge PY does not include such interference walls as in the process cartridges PM, PC, and PK. Although not shown, when the rib portion Y3 of the process cartridge PY is viewed from the optical scanning device 2 facing the same, a shape of the rib portion Y3 can also be said to be an I shape. Further, in the rib portion Y3 of the process cartridge PY, a width thereof in the longitudinal direction (right-and-left direction in FIG. 23) is shorter than those of the rib portions K3, C3, and M3 of the process cartridges PK, PC, and PM so that the collision walls 6Ka, 6Ca, and 6Ma of the incorrect mounting prevention portions 6K, 6C, and 6M are prevented from coming into contact with the rib portion Y3.

Note that, in this embodiment, such a mechanism that prevents the incorrect mounting of the process cartridge PY is not provided also on the cover member 5 of the optical scanning device 2. When the process cartridge PY is incorrectly mounted, at least one of the other process cartridges is also incorrectly mounted at the same time. Accordingly, there occurs no trouble which is caused by the fact that the incorrect mounting prevention mechanism is not provided for the process cartridge PY.

As mentioned above, as illustrated in FIG. 19, FIG. 21, and FIG. 22, the incorrect mounting prevention portions 6C, 6M, and 6K of the optical scanning device 2 and the interference walls C2, M2, and K2 are provided on both sides with the longitudinal centers of the respective process cartridges sandwiched therebetween while shifting the formed positions thereof for each of the process cartridges. Specifically, the positions where the incorrect mounting prevention portions 6M, 6C and 6K are formed on the cover member 5 so as to correspond to the process cartridges PM, PC, and PK are as follows. That is, in the order of the process cartridges PM, PC, and PK, the positions where the incorrect mounting prevention portions 6M, 6C and 6K are shifted from one another in directions of end portions thereof, the directions being perpendicular to the direction where the cartridge tray 40 moves to the housing position.

The order of the process cartridges PM, PC, and PK is also in a direction from a downstream side to an upstream side in the direction where the cartridge tray 40 moves to the housing position. Similarly, in the order of the process cartridges PM, PC, and PK, the positions where the interference walls M2, C2, and K2 of the process cartridges PM, PC, and PK are formed are also shifted from one another in the directions of the end portions thereof, the directions being perpendicular to the direction where the cartridge tray 40 moves to the housing position. Accordingly, when the process cartridges are mounted on the regular positions, the respective collision walls and the respective interference walls do not come into contact with each other in the insertion process. As a result, the cartridge tray 40 is housed in the housing portion T.

[Case in which Process Cartridge is Incorrectly Mounted]

Figure 24:
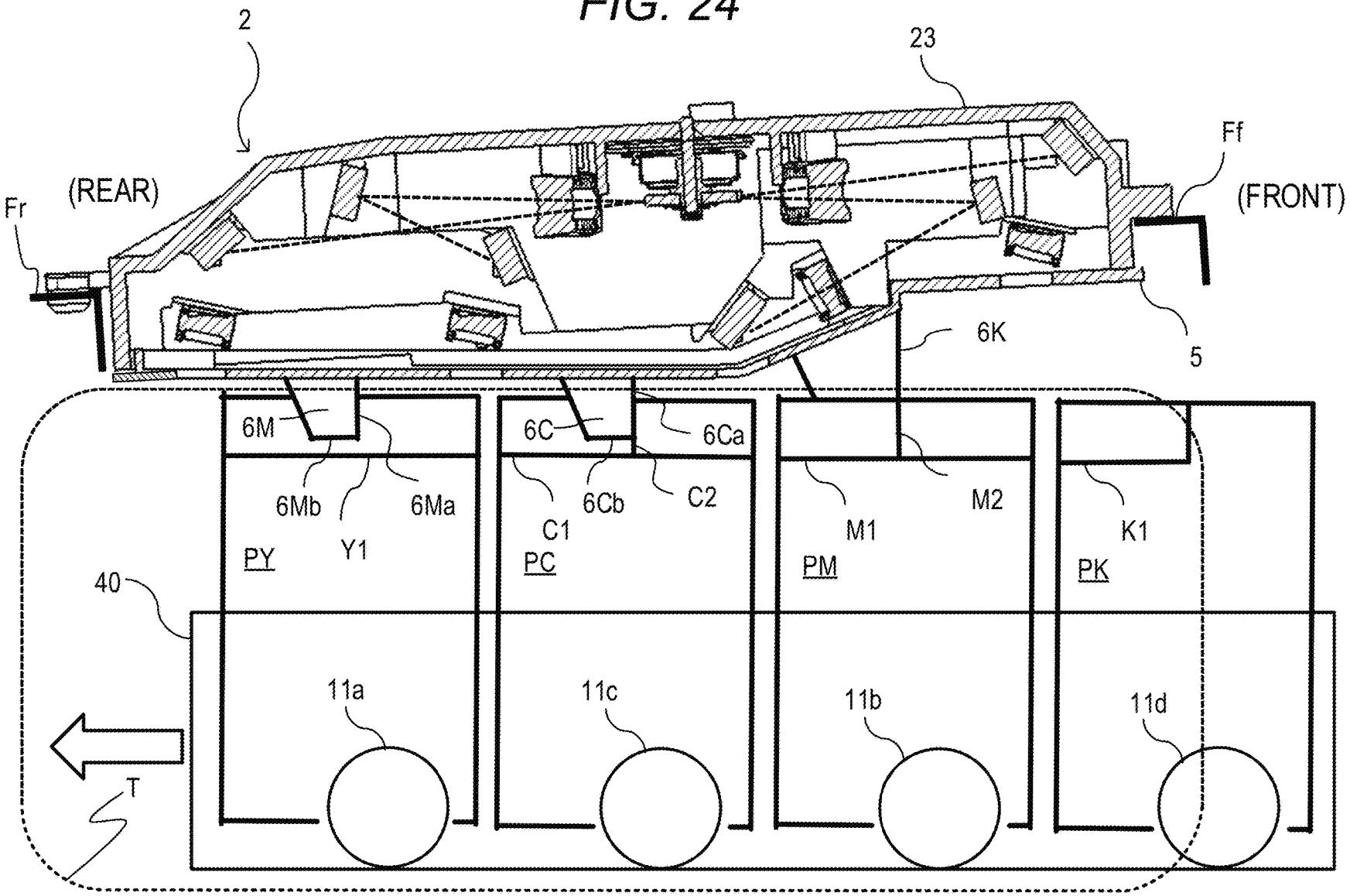
FIG. 24 is an explanatory view for illustrating an incorrect mounting state of the process cartridges of the fourth embodiment.

Next, a description is given of a case in which the process cartridge PC is incorrectly mounted. FIG. 24 is an explanatory view for illustrating, as an example of another incorrect mounting than in FIG. 18 mentioned above, a state when the cartridge tray 40 is inserted into the image forming apparatus 1 in a state in which the process cartridge PC is mounted on the position of the process cartridge PM.

When the cartridge tray 40 on which the process cartridge PC is incorrectly mounted is gradually inserted, the top surface portion Y1 of the process cartridge PY mounted on the regular position is lower than the bottom surfaces 6Kb, 6Cb, and 6Mb of the respective incorrect mounting prevention portions 6K, 6C, and 6M. Accordingly, the process cartridge PY passes through the incorrect mounting prevention portions 6K, 6C, and 6M without coming into contact with the same. Then, when the cartridge tray 40 is further inserted into the image forming apparatus 1, the process cartridge PC passes through the incorrect mounting prevention portions 6K without coming into contact with the same because installation positions of the incorrect mounting prevention portions 6K and the interference walls C2 are shifted from each other in the longitudinal direction of the process cartridge. However, when the incorrectly mounted process cartridge PC passes through the incorrect mounting prevention portions 6C, the collision walls 6Ca and the interference walls C2 come into contact with each other. Then, the collision walls 6Ca of the incorrect mounting prevention portions 6C are in contact with the interference walls C2 of the process cartridge PC, and hence the cartridge tray 40 is prevented from being inserted into the image forming apparatus 1 any more.

Further, for example, also when the process cartridge PC is incorrectly mounted on the position of the process cartridge PY, similarly to the case in which the process cartridge PC is mounted on the position of the process cartridge PM, the collision walls 6Ca and the interference walls C2 come into contact with each other when the process cartridge PC passes through the incorrect mounting prevention portions 6C. As a result, the cartridge tray 40 is prevented from being inserted into the image forming apparatus 1 any more.

The description has been given above of the case of the incorrect mounting of the process cartridge PC, and this also applies similarly to the incorrect mounting of the process cartridge PM. For example, considered is the case in which the cartridge tray 40 in which the process cartridge PM is incorrectly mounted on the position of the process cartridge PY is inserted. In this case, the process cartridge PM passes through the incorrect mounting prevention portions 6K without coming into contact with the same because installation positions of the incorrect mounting prevention portions 6K and the interference walls M2 are shifted from each other in the longitudinal direction of the process cartridge. Similarly, the process cartridge PM passes through the incorrect mounting prevention portions 6C without coming into contact with the same because installation positions of the incorrect mounting prevention portions 6C and the interference walls M2 are also shifted from each other in the longitudinal direction of the process cartridge. However, when the incorrectly mounted process cartridge PM passes through the incorrect mounting prevention portions 6M, the collision walls 6Ma and the interference walls M2 come into contact with each other. Then, the collision walls 6Ma of the incorrect mounting prevention portions 6M are in contact with the interference walls M2 of the process cartridge PM, and hence the cartridge tray 40 is prevented from being inserted into the image forming apparatus 1 any more.

As described above, when the cartridge tray 40 on which the process cartridge is incorrectly mounted is inserted into the image forming apparatus 1, the collision walls of the incorrect mounting prevention portions 6 corresponding to the incorrectly mounted process cartridge come into contact with the interference walls. Accordingly, the user can grasp the incorrect mounting. Then, depending on which of the incorrect mounting prevention portions 6M, 6C, and 6K corresponds to the collision wall of the incorrect mounting prevention portions 6 that has come into contact with the interference walls, it can be seen which of the process cartridges PM, PC, and PK corresponds to the incorrectly mounted process cartridge. Moreover, the mounting position of the incorrectly mounted process cartridge can be grasped based on a mounting position of the cartridge tray 40 on which the process cartridge in which the collision wall of the incorrect mounting prevention portion 6 has come into contact with the interference walls is mounted.

[Shock Absorption Mechanism when Process Cartridge is Incorrectly Mounted]

Next, a description is given of a mechanism that absorbs a shock when the process cartridge is incorrectly mounted.

[Mounting Mechanism of Cover Member of Optical Scanning Device to Housing]

Figure 25:
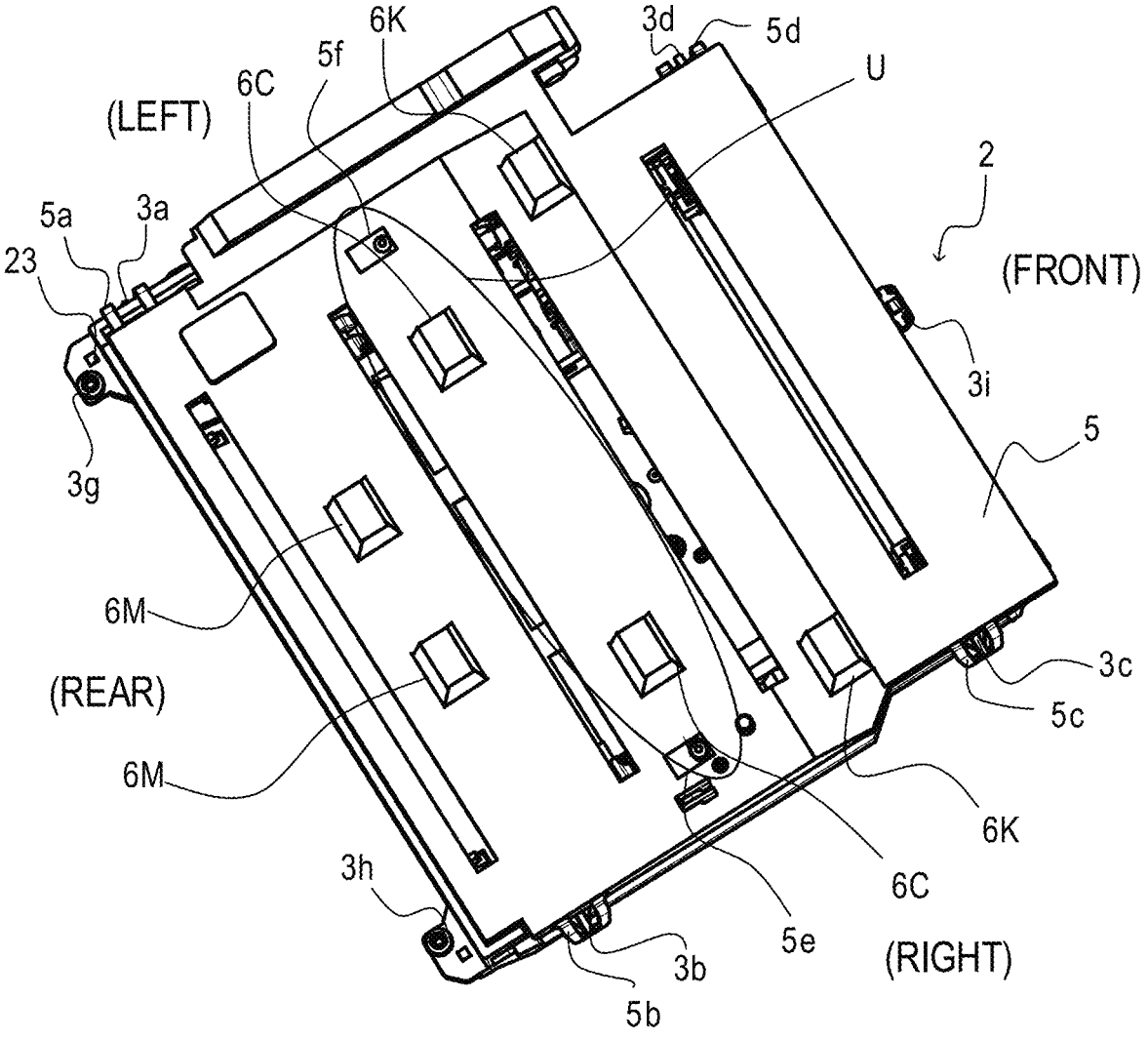
FIG. 25 is an explanatory view for illustrating a configuration of a cover member of the optical scanning device of the fourth embodiment.

FIG. 25 is a perspective view of the optical scanning device 2 in a state in which the cover member 5 is mounted on the optical box 23 when viewed from the cover member 5. In FIG. 25, elongated four opening portions in the right-and-left direction of the cover member 5 are opening portions from which the laser lights to be radiated to the photosensitive drums 11 are emitted. Pairs of trapezoidal members, each pair being provided in the right-and-left direction between the respective opening portions, are the above-mentioned incorrect mounting prevention portions 6M, 6C, and 6K. As illustrated in FIG. 25, the cover member 5 includes a plurality of fixing portions 5*a*, 5*b*, 5*c*, and 5*d* with the snap-fit structures, which serve for fixing the cover member 5 to the optical box 23. The fixing portions 5*a*, 5*b*, 5*c*, and 5*d* are provided on four corners of the optical box 23, and are elastically fixed to the optical box 23 by the snap-fit structures. The snap-fit structures of the fixing portions 5*a*, 5*b*, 5*c*, and 5*d* are molded integrally with the cover member 5, and have a square shape having an opening portion. When the cover member 5 is assembled to the optical box 23, the snap-fit structures of the fixing portions 5*a*, 5*b*, 5*c*, and 5*d* elastically bend, and thereby get over the protruding portions 3*a*, 3*b*, 3*c*, and 3*d* provided on the optical box 23. Then, the protruding portions 3*a*, 3*b*, 3*c*, and 3*d* engage with the opening portions of the snap-fit structures of the fixing portions 5*a*, 5*b*, 5*c*, and 5*d*. As described above, the protruding portions 3*a*, 3*b*, 3*c*, and 3*d* of the optical box 23 protrude from and engage with the opening portions provided in the snap-fit structures of the fixing portions 5*a*, 5*b*, 5*c*, and 5*d*, respectively. Accordingly, the cover member 5 is held by the optical box 23. Note that, a portion U surrounded by an ellipse in FIG. 25, the portion U including the incorrect mounting prevention portion 6C and holes 5*e* and 5*f*, will be described with reference to FIG. 26A and FIG. 26B. Further, bosses 3*g* and 3*h* and a seat surface 3*i*, which are illustrated in FIG. 25, will be described with reference to FIG. 27A, FIG. 27B, and FIG. 27C.

[Configuration of Shock Absorption Mechanism by Cover Member of Optical Scanning Device]

Figure 26B:
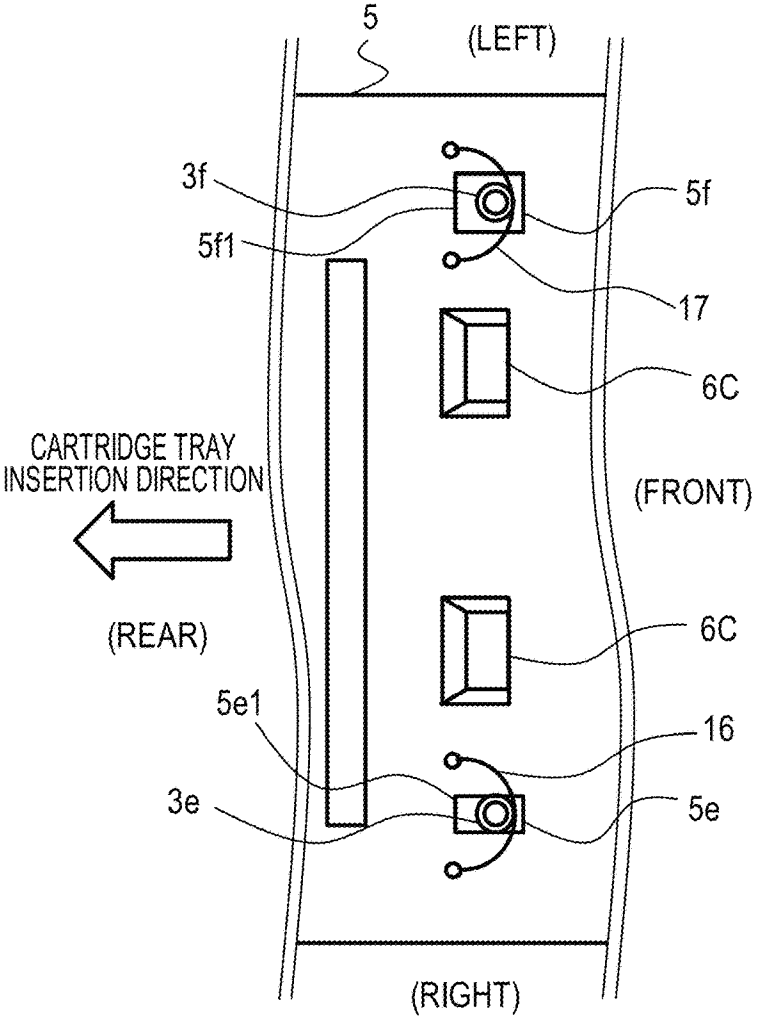
FIG. 26A and FIG. 26B are explanatory views for illustrating a shock absorption mechanism of the cover member of the optical scanning device of the fourth embodiment.
Figure 26A:
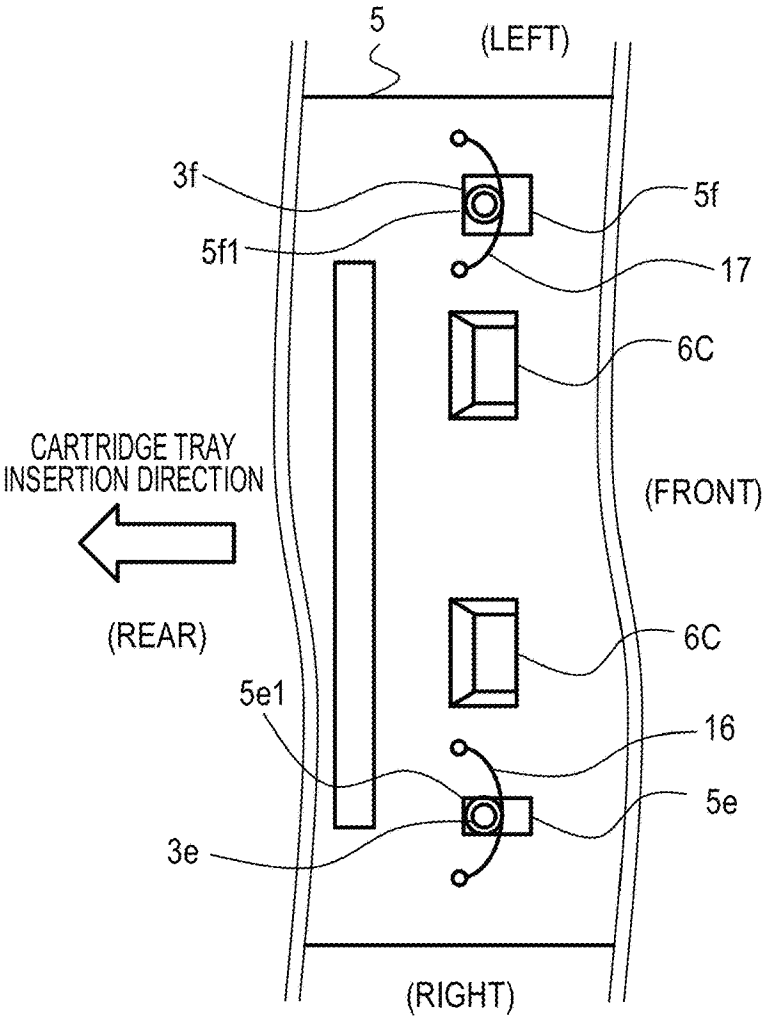

Subsequently, a description is given of a shock absorption mechanism by the cover member of this embodiment. FIG. 26A and FIG. 26B are explanatory enlarged views of the portion U in FIG. 25, for illustrating a shock absorption operation when the collision walls of the incorrect mounting prevention portions 6 provided on the cover member 5 receive shock due to the incorrect mounting when coming into contact with the interference walls of the process cartridge.

FIG. 26A is a view for illustrating a state of the portion U, when the respective process cartridges are mounted on the regular positions of the cartridge tray 40, and the cartridge tray 40 is housed in the housing portion T of the image forming apparatus 1. The cover member 5 is held on the optical box 23 by the snap-fit structures of the above-mentioned fixing portions 5*a*, 5*b*, 5*c*, and 5*d*. However, by this means alone, the position of the cover member 5 to the optical box 23 is not firmly determined. Accordingly, the cover member 5 of this embodiment is provided with the holes 5*e* and 5*f* which are opening portions, and bosses 3*e* and 3*f* individually provided on the optical box 23 and provided upright toward the cover member 5 are inserted into the holes 5*e* and 5*f*, respectively. Then, springs 16 and 17 which are first elastic members bridging the holes 5*e* and 5*f* are installed on the cover member 5, and by the springs 16 and 17, the bosses 3*e* and 3*f* (first protruding portions) which protrude from the holes 5*e* and 5*f* are urged behind the image forming apparatus 1 (that is, toward insertion direction of the cartridge tray 40). In this embodiment, a width of the spring 16 in a bridging direction of the hole 5*e* and a diameter of the boss 3*e* are set into a fitting relationship, and a width of the spring 17 in a bridging direction of the hole 5*f* and a diameter of the boss 3*f* are also set into a fitting relationship. Then, by being urged by the springs 16 and 17, the bosses 3*e* and 3*f* are brought into abutment against end surfaces 5*e*1 and 5*f*1 of the holes 5*e* and 5*f*, respectively (first positions). The end surfaces 5*e*1 and 5*f*1 are located downstream in the insertion direction of the cartridge tray 40. As a result, by the engagement of the fixing portions of the cover member 5 and the optical box 23 by the above-mentioned snap-fit structures, the cover member 5 is positioned to the optical box 23.

Subsequently, with reference to FIG. 26B, a description is given of the shock absorption operation of the cover member 5 when the process cartridge is incorrectly mounted. FIG. 26B is a view for illustrating a state of the cover member 5 when the collision walls of the incorrect mounting prevention portions 6 provided on the cover member 5 collide with the interference walls of the process cartridge in the process of inserting, into the image forming apparatus 1, the cartridge tray 40 on which the process cartridge is incorrectly mounted. The collision walls of the incorrect mounting prevention portions 6 collide with the interference walls of the incorrectly mounted process cartridge. Accordingly, the cover member 5 receives shock in the insertion direction of the cartridge tray 40. As mentioned above, the cover member 5 is only urged to the insertion direction of the cartridge tray 40, by elastic force of the springs 16 and 17, and against urging force of the springs 16 and 17, temporarily moves in the insertion direction of the cartridge tray (second position) together with the shock at the time of collision. A width of the holes 5*e* and 5*f* of the cover member 5 in the insertion direction of the cartridge tray 40 is set larger than a movement amount of the cover member 5. Accordingly, the bosses 3*e* and 3*f* of the optical box 23 do not collide with opposite end surfaces of the holes 5*e* and 5*f* to the insertion direction of the cartridge tray 40. Note that the movement amount of the cover member 5 is a length (distance) of a gap between the collision walls of the incorrect mounting prevention portions 6 and the interference walls of the process cartridge when the process cartridge is mounted on the regular position.

The cartridge tray 40 is prevented from being inserted into the image forming apparatus 1, and hence the user recognizes that the process cartridge is incorrectly mounted, and performs an operation of drawing out the cartridge tray 40 from the image forming apparatus 1. Thus, the cover member 5 moves in a direction opposite to the insertion direction of the cartridge tray 40. As a result, by urging force of the springs 16 and 17 in each of which a bending amount is increased, the cover member 5 returns until the bosses 3*e* and 3*f* are brought into abutment against the end surfaces 5*e*1 and 5*f*1 of the holes 5*e* and 5*f* (state illustrated in FIG. 26A). As described above, the cover member 5 is elastically urged so as to be movable in the direction of receiving shock, thus making it possible to absorb the shock by the elastic force.

[Configuration of Shock Absorption Mechanism by Optical box of Optical Scanning Device]

Subsequently, with reference to FIG. 27A, FIG. 27B, and FIG. 27C, a description is given of a shock absorption mechanism of the optical box 23 of the optical scanning device 2.

Figure 27A:
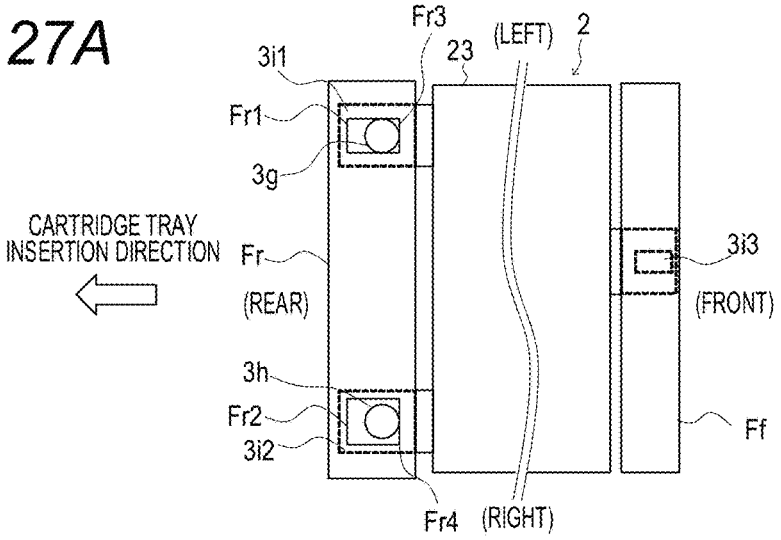
FIG. 27A, FIG. 27B, and FIG. 27C are explanatory views for illustrating a shock absorption mechanism of an optical box of the optical scanning device of the fourth embodiment.
Figure 27B:
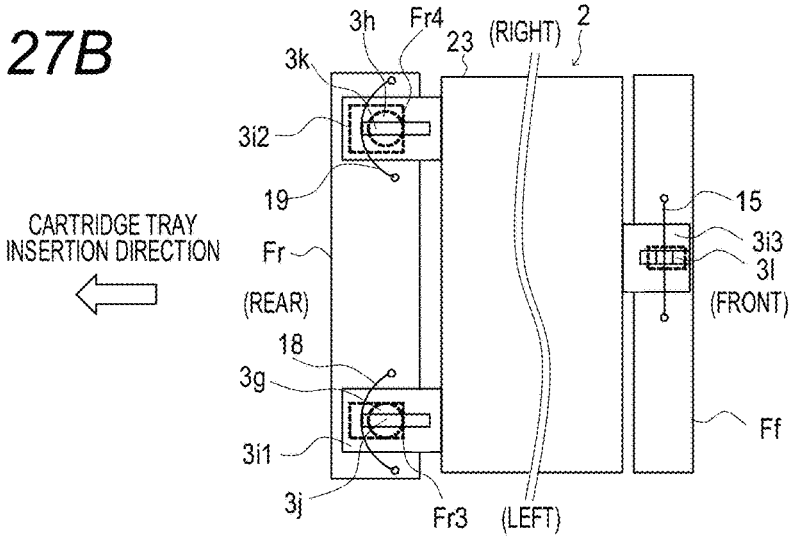

FIG. 27A is a view of frame (Ff, Fr) installation portions of the optical scanning device 2 when the cartridge tray 40 in which the process cartridges are mounted on the regular positions is housed in the housing portion T of the image forming apparatus 1, frame (Ff, Fr) installation portions being viewed from the process cartridges. Moreover, FIG. 27B is a view of the optical scanning device 2 in a state illustrated in FIG. 27A when viewed from above the optical scanning device 2. Note that the frame (Ff, Fr) installation portions are installation portions for fixing the optical scanning device 2 to the front frame Ff of the image forming apparatus 1 and the rear frame Fr thereof.

As illustrated in FIG. 27A, in the optical scanning device 2, the seat surfaces 3*i*1 and 3*i*2 of the optical box 23 abut against the frame Fr of the image forming apparatus 1, and the seat surface 3*i*3 of the optical box 23 abuts against the frame Ff of the image forming apparatus 1. Then, by the fact that the seat surfaces 3*i*1 and 3*i*2 of the optical box 23 abut against the frame Fr of the image forming apparatus 1, the bosses 3*g* and 3*h* (second protruding portions) provided on the seat surfaces 3*i*1 and 3*i*2 of the optical box 23 are inserted through holes Fr1 and Fr2, which are provided in the frame Fr, respectively. Further, as illustrated in FIG. 27B, end portions (end portions toward the insertion direction of the cartridge tray 40) of ribs 3*j* and 3*k* provided upright on the seat surfaces 3*i*1 and 3*i*2 of the optical box 23 of the optical scanning device 2 are urged by springs 18 and 19 which are second elastic members.

The springs 18 and 19 urge the ribs 3*j* and 3*k*, which are installed on the frame Fr, in the direction opposite to the insertion direction of the cartridge tray 40. Thus, the bosses 3*g* and 3*h* are brought into abutment against opposite end surfaces Fr3 and Fr4 of the holes Fr1 and Fr2 to the insertion direction of the cartridge tray 40 (third position). Meanwhile, a rib 31 provided upright on the seat surface 3*i*3 of the optical box 23 of the optical scanning device 2 is urged toward the frame Ff by a spring 15 bridged astride the rib 31.

In this embodiment, a width of the spring 18 in a bridging direction of the hole Fr1 of the frame Fr and a diameter of the boss 3*g* are set into a fitting relationship, and a width of the spring 19 in a bridging direction of the hole Fr2 of the frame Fr and a diameter of the boss 3*h* are also set in a fitting relationship. Then, by being urged by the springs 18 and 19, the bosses 3*g* and 3*h* are brought into abutment against the end surfaces Fr3 and Fr4 of the holes Fr1 and Fr2, respectively, and the seat surfaces 3*i*1, 3*i*2 and 3*i*3 of the optical box 23 are fixed to the frames Fr and Ff. Thus, the position of the optical scanning device 2 to the frames Ff and Fr of the image forming apparatus 1 is determined.

[Shock Absorption Operation of Shock Absorption Mechanism by Optical Box of Optical Scanning Device]

Figure 27C:
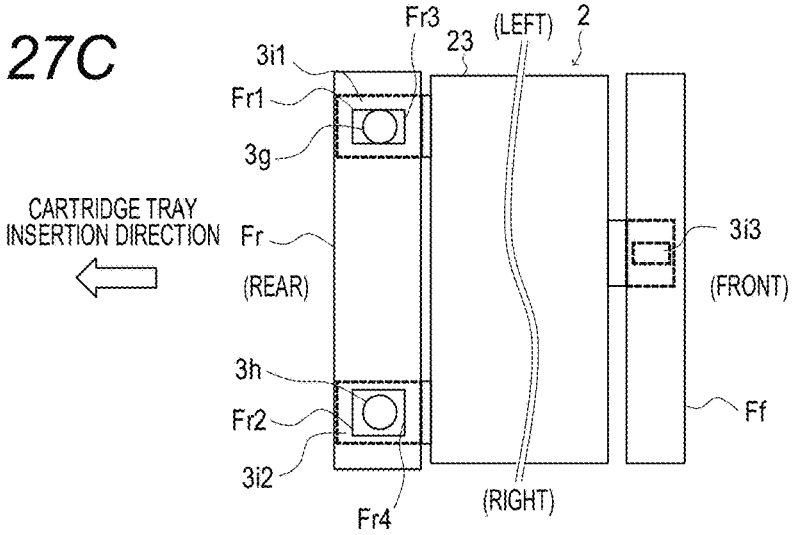

Next, with reference to FIG. 27C, a description is given of a shock absorption operation of the optical scanning device 2 when the process cartridge is incorrectly mounted. FIG. 27C is a view for illustrating a state of the frame (Ff, Fr) installation portions of the optical scanning device when the interference walls of the process cartridge incorrectly mounted on the cartridge tray 40 collide with the collision walls of the incorrect mounting prevention portions 6 provided on the cover member 5.

The collision walls of the incorrect mounting prevention portions 6 collide with the interference walls of the incorrectly mounted process cartridge. Accordingly, the optical scanning device 2 receives shock in the insertion direction of the cartridge tray 40. As mentioned above, the optical scanning device 2 is only urged to the insertion direction of the cartridge tray 40 by elastic force of the springs 18 and 19. Accordingly, against urging force of the springs 18 and 19, the optical scanning device 2 (optical box 23) temporarily moves in the insertion direction of the cartridge tray 40 together with the shock at the time of collision (fourth position). A width of the holes Fr1 and Fr2 of the frame Fr in the insertion direction of the cartridge tray 40 is set larger than a movement amount of the optical scanning device 2. Accordingly, the bosses 3*g* and 3*h* of the optical box 23 do not collide with opposite end surfaces of the holes Fr1 and Fr2 to the insertion direction of the cartridge tray 40. Note that the movement amount of the optical scanning device 2 is a length (distance) of a gap between the collision walls of the incorrect mounting prevention portions 6 and the interference walls of the process cartridge when the process cartridge is mounted on the regular position.

The cartridge tray 40 is prevented from being inserted into the image forming apparatus 1, and hence the user recognizes that the process cartridge is incorrectly mounted, and performs an operation of drawing out the cartridge tray 40 from the image forming apparatus 1. Thus, the optical scanning device 2 moves in a direction opposite to the insertion direction of the cartridge tray 40. As a result, by urging force of the springs 18 and 19 in each of which a bending amount is increased, the optical scanning device 2 returns until the bosses 3*g* and 3*h* are brought into abutment against the end surfaces Fr3 and Fr4 of the holes Fr1 and Fr2 (state illustrated in FIG. 27A). As described above, the optical scanning device 2 is elastically urged so as to be movable in the direction of receiving shock. Accordingly, the shock to the optical scanning device can be reduced to suppress a change of optical characteristics, for example, a spot diameter.

In this embodiment, the description has been given of the case in which the process cartridges PK, PC, and PM are incorrectly mounted on the positions where the process cartridges PC, PM, and PY are to be mounted, respectively, the positions being downstream with respect to the regular position of the cartridge tray 40 in the insertion direction of the cartridge tray 40. The above description can also be said to be, on the contrary, of an example of the case in which the process cartridges PC, PM, and PY are incorrectly mounted on the mounting positions of the PK, PC, and PM on the cartridge tray 40, respectively, the mounting positions being upstream with respect to the regular position of the cartridge tray 40 in the insertion direction of the cartridge tray 40. Further, though the incorrect mounting prevention portions and the interference walls are not provided for the process cartridge PY, the fact that the process cartridge PY is incorrectly mounted means that another process cartridge is incorrectly mounted on the position of the process cartridge PY. Hence, the fact that the remaining three process cartridges PM, PC and PK are prevented from being incorrectly mounted means that the incorrect mounting prevention mechanism functions.

Further, though the configuration in which the process cartridges PY, PM, PC, and PK are mounted on the cartridge tray 40 in the stated order has been described in this embodiment, the order of mounting the process cartridges may be any suitable order. That is, when the configuration of the incorrect mounting prevention portions 6 of the cover member 5 remains the same, for example, as the configuration illustrated in FIG. 20, it is only required that the interference walls of the rib portions of the process cartridges to be mounted on the cartridge tray 40 correspond to the collision walls of the incorrect mounting prevention portions 6. As described above, in the color image forming apparatus that uses the plurality of process cartridges, it is not required to add a component dedicated to prevent the incorrect mounting. Accordingly, the downsizing of the image forming apparatus 1 is not impaired.

As described above, according to this embodiment, the process cartridge can be prevented from being incorrectly mounted without impairing the downsizing of the image forming apparatus.

Fifth Embodiment

In the fourth embodiment, the description has been given of the embodiment of preventing the incorrect mounting of the process cartridge in the color image forming apparatus with the configuration in which the plurality of process cartridges are mounted on the cartridge tray. In a fifth embodiment, a description is given of an embodiment of preventing the incorrect mounting of the process cartridge in a color image forming apparatus with a configuration in which the process cartridges are individually replaceable.

[Configuration of Optical Scanning Device]

Figure 28:
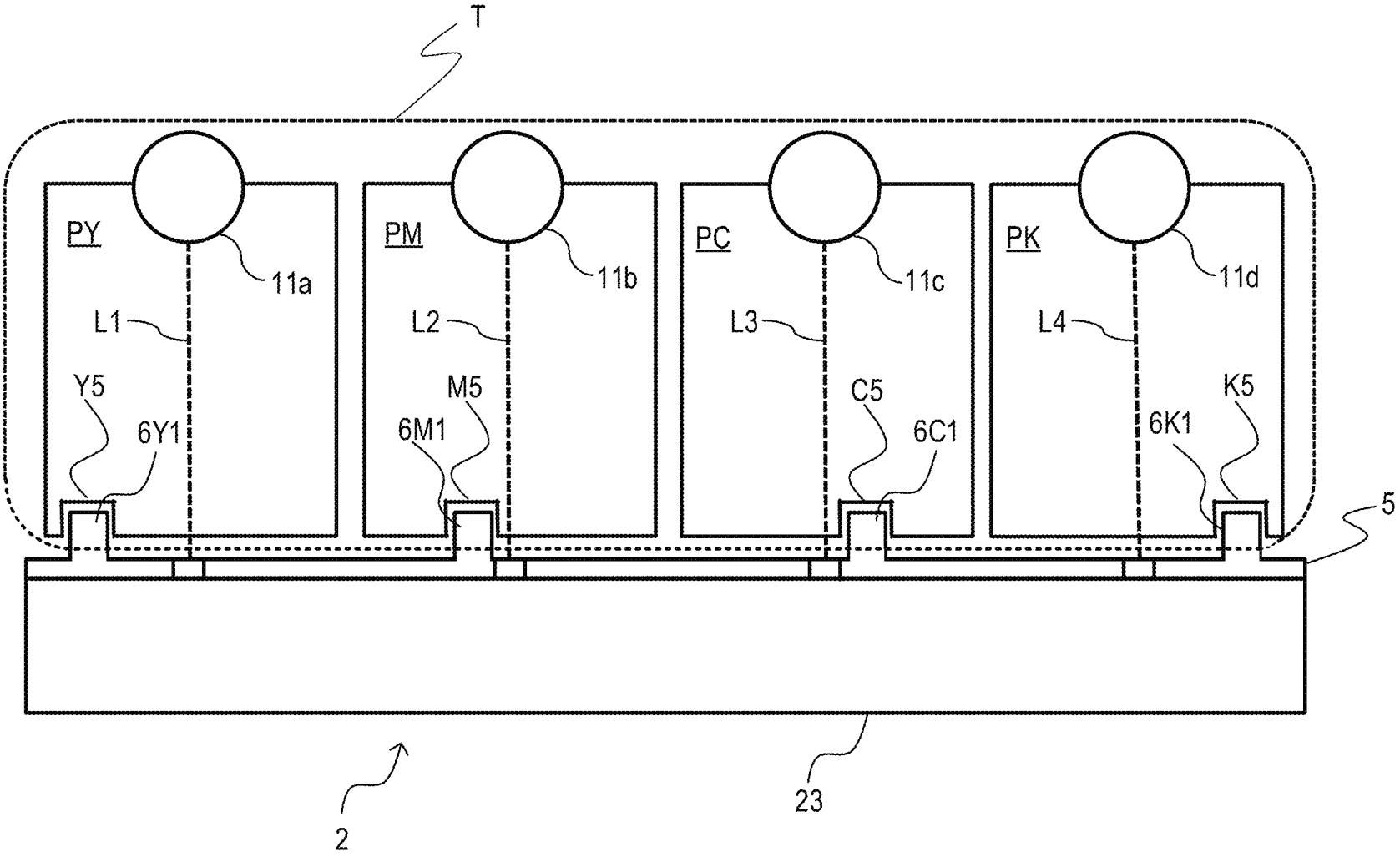
FIG. 28 is an explanatory view for illustrating incorrect mounting prevention mechanisms of process cartridges of a fifth embodiment.

FIG. 28 is an explanatory schematic sectional view for illustrating configurations of a housing portion T of process cartridges PY, PM, PC, and PK in an image forming apparatus 1 of this embodiment, and of an optical scanning device 2 that is adjacent to the housing portion T and radiates laser lights to respective photosensitive drums 11 of the process cartridges PY, PM, PC, and PK. In the first embodiment, the optical scanning device 2 is disposed vertically above the process cartridges PY, PM, PC, and PK, and is configured to radiate the laser lights to the respective photosensitive drums 11 of the process cartridges PY, PM, PC, and PK arranged vertically below the same. Meanwhile, in this embodiment, the optical scanning device 2 is disposed vertically below the process cartridges PY, PM, PC, and PK, and is configured to apply the laser lights to the photosensitive drums 11 of the process cartridges PY, PM, PC, and PK arranged vertically above the same. In the second embodiment also, an internal configuration of the optical scanning device 2 is similar to that in the first embodiment, and the cover member 5 is disposed so as to face the process cartridges PY, PM, PC, and PK. Note that, in FIG. 28, the same reference symbols denote members having functions similar to those in the fourth embodiment, and a description thereof is omitted.

The process cartridges PY, PM, PC, and PK in this embodiment are different from those in the configuration of the first embodiment in that the process cartridges PY, PM, PC, and PK can be individually replaced and mounted. Further, the respective process cartridges are mounted and detached in a direction perpendicular to the sheet surface of FIG. 28, which is a rotation axis direction of the photosensitive drums 11. For example, in the case of drawing out each of the process cartridges, the process cartridge is drawn out to the front side of the sheet surface in the direction perpendicular to the sheet surface of FIG. 28, and in the case of mounting the process cartridge, the process cartridge is inserted into the depth side of the sheet surface in the direction perpendicular to the sheet surface of FIG. 28.

Then, in this embodiment, in order to prevent the incorrect mounting of the process cartridges, incorrect mounting prevention portions 6Y1, 6M1, 6C1, and 6K1 which are projections which have a protruding shape and project toward the process cartridges PY, PM, PC, and PK are provided on the cover member 5 of the optical scanning device 2. Meanwhile, groove portions Y5, M5, C5, and K5 which have a recessed shape are provided at positions of process cartridges PY, PM, PC, and PK, which face the incorrect mounting prevention portions 6Y1, 6M1, 6C1, and 6K1 of the cover member 5. The incorrect mounting prevention portions 6Y1, 6M1, 6C1, and 6K1 provided on the cover member 5 of the optical scanning device 2 and the groove portions Y5, M5, C5, and K5 provided on the process cartridges PY, PM, PC, and PK are formed across the direction perpendicular to the sheet surface of FIG. 28, that is, across both end portions in the longitudinal direction thereof. Further, the groove portions Y5, M5, C5, and K5 are formed while being shifted in position from one another in an array direction of the photosensitive drums among the process cartridges. The incorrect mounting prevention portions 6Y1, 6M1, 6C1, and 6K1 provided on the cover member 5 of the optical scanning device 2 are formed while being shifted in position from one another among the process cartridges.

FIG. 28 is a view for illustrating a case in which the process cartridges PY, PM, PC, and PK are mounted on regular positions. In FIG. 28, the respective protrusions of the incorrect mounting prevention portions 6Y1, 6M1, 6C1, and 6K1 provided on the cover member 5 and the respective recesses of the groove portions Y5, M5, C5, and K5 of the process cartridges PY, PM, PC, and PK properly correspond to each other, and accordingly, the respective process cartridges are housed in the housing portion T. Meanwhile, when the process cartridges are incorrectly mounted, the protrusions of the incorrect mounting prevention portions provided on the cover member 5 of the optical scanning device 2 and the recesses provided on the process cartridges do not correspond to each other. Accordingly, the process cartridges are prevented from being housed in the housing portion T, and the user can recognize the incorrect mounting.

Further, also with regard to such a mechanism of absorbing a shock at the time of the incorrect mounting, the mechanism having been described in the fourth embodiment, the configuration of the fourth embodiment can be applied to this embodiment. Note that, in this embodiment, the optical scanning device 2 is configured to be disposed vertically below the process cartridges PY, PM, PC, and PK. This embodiment is also applicable to a configuration similar to that in the fourth embodiment, in which the optical scanning device 2 is disposed vertically above the process cartridges PY, PM, PC, and PK. Further, it is only required that the positions where the respective protrusions of the incorrect mounting prevention portions 6Y1, 6M1, 6C1, and 6K1 are formed and the positions where the respective recesses of the groove portions Y5, M5, C5, and K5 of the process cartridges PY, PM, PC, and PK are formed corresponding to each other, and are not limited to the positions illustrated in FIG. 28. As mentioned above, in the color image forming apparatus that uses the plurality of process cartridges, it is not required to add a component dedicated to prevent the incorrect mounting. Accordingly, the downsizing of the image forming apparatus 1 is not impaired.

As described above, according to this embodiment, the process cartridge can be prevented from being incorrectly mounted without impairing the downsizing of the image forming apparatus.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-209699, filed Dec. 17, 2020, and Japanese Patent Application No. 2021-087163, filed May 24, 2021, which are hereby incorporated by reference herein in their entirety.

What is claimed is:

1. An image forming apparatus to form a toner image on a recording material, the image forming apparatus comprising:

a photosensitive member; and an optical scanning unit configured to scan the photosensitive member with a laser light according to image information, wherein the optical scanning unit includes:

a light source, a deflector configured to deflect the laser light emitted from the light source, an imaging lens configured to form an image of the laser light deflected by the deflector, an optical box configured to hold the deflector and the imaging lens, a cover member configured to cover an opening of the optical box, and a moving unit movable to an outside of the image forming apparatus, wherein the optical scanning unit and the moving unit are arranged so that the moving unit and the optical scanning unit are opposed to each other in a state in which the moving unit is located in an inside of the image forming apparatus, wherein the optical scanning unit is disposed so as to allow a user to touch the optical scanning unit through a space generated in the inside of the image forming apparatus when the moving unit is moved to the outside of the image forming apparatus, and wherein, of the optical box and the cover member, the cover member is opposed to the moving unit.

2. The image forming apparatus according to claim 1, wherein the moving unit is a cassette configured to house the recording material to which the toner image is transferred.

3. The image forming apparatus according to claim 2, wherein the optical scanning unit is disposed vertically below the photosensitive member.

4. The image forming apparatus according to claim 1, wherein the deflector includes a rotary polygon mirror configured to deflect the laser light, and wherein the rotary polygon mirror is disposed vertically below a drive circuit board configured to drive the deflector.

5. The image forming apparatus according to claim 1, wherein the cover member is made of a resin, and at least a region of a portion, on a side opposed to the moving unit, of the cover member is roughened.

6. The image forming apparatus according to claim 1, wherein the cover member is made of a resin, and has an electrical resistivity of 1×1011 ohm-meter (Ω·m) or less.

7. The image forming apparatus according to claim 1, wherein the moving unit is a cartridge tray configured to house a first process cartridge including the photosensitive member.

8. The image forming apparatus according to claim 7, wherein the optical scanning unit is disposed vertically above the photosensitive member.

9. The image forming apparatus according to claim 7, further comprising a plurality of process cartridges, wherein the moving unit is configured to house the plurality of process cartridges, wherein the cover member includes a plurality of incorrect mounting prevention portions which protrude toward the moving unit, and wherein, when the moving unit is moved toward the inside of the image forming apparatus in a state in which at least one of the plurality of process cartridges is mounted on an incorrect position with respect to the moving unit, a second process cartridge mounted on the incorrect position interferes with one of the plurality of incorrect mounting prevention portions.

10. The image forming apparatus according to claim 9, wherein the plurality of incorrect mounting prevention portions are provided at a plurality of positions of the cover member corresponding to the plurality of process cartridges, respectively.

11. The image forming apparatus according to claim 10, wherein each of the plurality of process cartridges is provided with a wall portion configured to abut against a corresponding incorrect mounting prevention portion of the plurality of incorrect mounting prevention portions when the moving unit is moved toward the inside of the image forming apparatus in a state in which a corresponding process cartridge is mounted on the incorrect position with respect to the moving unit, wherein the corresponding incorrect mounting prevention portion corresponding to each of the plurality of process cartridges is provided at each of plural positions in a rotational axis direction of the photosensitive member, and wherein the wall portion of each of the plurality of process cartridges is provided at each of the plurality of positions in the rotational axis direction.

12. The image forming apparatus according to claim 11, wherein a number of incorrect mounting prevention portions corresponding to each of the plurality of process cartridges is two, and wherein a distance between the two incorrect mounting prevention portions of the plurality of incorrect mounting prevention portions increases from a downstream side toward an upstream side in a mounting direction of the moving unit.

13. The image forming apparatus according to claim 12, wherein, of the plurality of process cartridges, a third process cartridge on a most downstream side in the mounting direction of the moving unit lacks the wall portion.

14. The image forming apparatus according to claim 13, wherein an incorrect mounting prevention portion is absent at a position of the cover member corresponding to the process cartridge on the most downstream side.

15. The image forming apparatus according to claim 11, wherein the cover member includes a first opening portion through which a first protruding portion of the optical box is inserted, and includes a first elastic member configured to urge the first protruding portion inserted through the opening portion, and wherein the first elastic member urges the first protruding portion in a mounting direction of the moving unit.

16. The image forming apparatus according to claim 15, wherein the cover member is movable between a first position in which none of the plurality of incorrect mounting prevention portions is in contact with the wall portion and a second position in which the corresponding incorrect mounting prevention portion is in contact with the wall portion, and wherein, when the corresponding incorrect mounting prevention portion separates away from the wall portion, the first elastic member moves the cover member from the second position to the first position.

17. The image forming apparatus according to claim 16, further comprising a frame configured to support the optical scanning unit, wherein the frame includes a second opening portion through which a second protruding portion of the optical box is inserted, and includes a second elastic member configured to urge the second protruding portion inserted through the opening portion, and wherein the second elastic member urges the second protruding portion in a direction opposite to the mounting direction of the moving unit.

18. The image forming apparatus according to claim 17, wherein the optical box is movable between a third position in which the corresponding incorrect mounting prevention portion is out of contact with the wall portion and a fourth position in which the corresponding incorrect mounting prevention portion is in contact with the wall portion, and wherein, when the corresponding incorrect mounting prevention portion separates away from the wall portion, the second elastic member moves the optical box from the fourth position to the third position.

19. The image forming apparatus according to claim 9, wherein the optical scanning unit is disposed vertically above the plurality of process cartridges mounted on the moving unit.

* * * * *